United States Patent [19]

Sakura

[11] 4,434,911

[45] Mar. 6, 1984

[54] LABEL FEED CONTROL SYSTEM

[75] Inventor: Yasuhiro Sakura, Shizuoka, Japan

[73] Assignee: Tokyo Electric Co., Ltd., Tokyo, Japan

[21] Appl. No.: 290,307

[22] Filed: Aug. 5, 1981

[30] Foreign Application Priority Data

| | | | |
|---|---|---|---|
| Aug. 14, 1980 | [JP] | Japan | 55-111980 |
| Aug. 14, 1980 | [JP] | Japan | 55-111981 |
| Aug. 15, 1980 | [JP] | Japan | 55-112441 |

[51] Int. Cl.[3] ..... B65H 5/28; B65H 7/02

[52] U.S. Cl. ..... 221/2; 221/13; 221/21; 221/73; 156/542; 156/584

[58] Field of Search ..... 221/2, 9, 13, 21, 22, 221/23, 69–73; 156/361, 540–542, 584

[56] References Cited

U.S. PATENT DOCUMENTS

| | | | |
|---|---|---|---|
| 4,038,127 | 7/1977 | Bullock et al. | 156/361 X |
| 4,048,494 | 9/1977 | Liesting | 221/73 X |
| 4,188,252 | 2/1980 | Brown | 156/542 |
| 4,288,272 | 9/1981 | Pfeffer | 221/73 X |
| 4,303,461 | 12/1981 | LaMers | 156/361 |
| 4,347,950 | 9/1982 | Ohishi | 221/21 X |

FOREIGN PATENT DOCUMENTS

| | | |
|---|---|---|
| 2605602 | 8/1977 | Fed. Rep. of Germany . |
| 382643 | 12/1964 | Switzerland . |

*Primary Examiner*—F. J. Bartuska

*Attorney, Agent, or Firm*—Oblon, Fisher, Spivak, McClelland & Maier

[57] ABSTRACT

A label feed control system for separating labels sequentially from the base ribbon. The base ribbon is transported for a certain length after the front edge of each label has been detected. The feed amount of the label after its front edge has been detected is substantially constant even if the front edge detector is interfered by a finger or the like and a label detection signal is erroneously generated.

9 Claims, 42 Drawing Figures

LABEL FEED CONTROL SYSTEM

BACKGROUND OF THE INVENTION

1. Field of the Invention

The present invention relates to a label printer, and particularly to a label feed control system for a label printer which issues a label after data from the weighing unit has been printed on the label stuck on the paper base ribbon.

2. Description of the Prior Art

An example of the conventional label feed control system will be described with reference to FIGS. 1 through 4. On a paper base ribbon 1 there are stuck labels 2 of a certain size in a constant interval, and such a ribbon 1 is wound on a label supply reel 3. The ribbon 1 is transported to a ribbon take-up reel 8 through a printer 4, a separator 5 on which a label is peeled off the base ribbon, and a feed roller 7 driven by a motor 6. On the upstream side of the printer 4 there is provided a photoelectric label position detector 9, and a label detector 10 for detecting a peeled-off label 2 is provided on the front of the separator 5.

The weighing unit 11, the printer 4 and a keyboard 12 are connected to a CPU 13, which is further connected to an I/O port 14. The label detector 10 is connected through a label detection amplifier 15 to the I/O port 14. Also connected to the I/O port 14 is a feed controller 16, which is further connected to the motor 6 and to the position detector 9 through a position detection amplifier 18 having a variable resistor 17.

The label detector 10 produces a high D-signal when a label is absent, and when an operation command, i.e. an A-signal, is issued with the signal D being high, the feed controller 16 produces a high C-signal to activate the motor 6 so that the ribbon 1 is fed. The signal C is also delivered to the CPU 13 via the I/O port 14 so as to interlock other operations during the transportation of the ribbon. As the result of transporting the ribbon 1, a label 2 is peeled off the ribbon 1, projecting over the label detector 10 to cause its output signal D to become low. When the position detector 9 detects the label position and produces a B-signal, as will be described shortly, with the signal D being low, the signal C from the feed controller 16 goes low to stop the motor 6 and also to release the inhibited commands in the CPU 13.

The position detector 9 operates by sensing the transmissivity of the base ribbon 1 and the label 2. There are three cases in the degree of transmissivity as shown in FIG. 2-*b*: (a) with the base ribbon 1 alone, (b) with the label 2 on the base ribbon 1, and (c) with the label 2 having a printed portion 20 stuck on the base ribbon 1. The signal B is produced at the position where the base ribbon 1 alone-exists. This system is based on the detection of the difference of light transmitted through the base ribbon 1 alone and the overlap of the base ribbon 1 and the label 2, and has the following problems. A label 2 having a high light transmissivity results in a very small difference in the light level, requiring disadvantageously a very high accuracy of detection. If the label 2 has a printed portion 20 as mentioned above for the shop name and the like, the lower transmissivity of this portion creates a large contrast relative to remaining portions of the label, resulting possibly in a failure of detection. Moreover, it is irksome to adjust the sensing level by the variable resistor 17 each time the thickness of the base ribbon 1 is changed. In addition, the position detector 9 needs to be repositioned for each label size, and since the signal B from the position sensor 9 also serves as the operational reference for the printer 4, several labels are wasted for test printing before the best set position is determined.

The applicant has proposed an arrangement for positioning the label accurately by detecting it reliably. In such arrangement, instead of the position detector 9 in FIG. 1 the label detector 10 functions to detect the front edge of the label 2 and also the presence of a label, so that the label is fed for a certain length in response to the detection of the front edge. However, since the detector 10 is located in front of the separator 5, if the operator put his fingers into the detector 10 to pick the label 2 during printing, the detector 10 responds to the fingers before it correctly detects the front edge of the label 2. Thus the label is fed for a certain length from that point abnormally, resulting in a shift in the print position when the label is printed by the printer 4, and the label is wasted.

Furthermore, if the label detector 10 fails to detect the label, holding the system in a virtual label absent state, label transportation is not controlled properly and labels are wasted.

The present invention is contemplated to overcome these deficiencies while utilizing the advantages of the front edge detection system. Accordingly, an object of the invention is to provide a label feed control system which minimizes the label positioning error when the label detector creates an erroneous signal or fails to operate.

BRIEF DESCRIPTION OF THE DRAWINGS

FIG. 28 is an illustration showing the abnormal label feed;

DETAILED DESCRIPTION OF THE PREFERRED EMBODIMENTS

Figure 1:
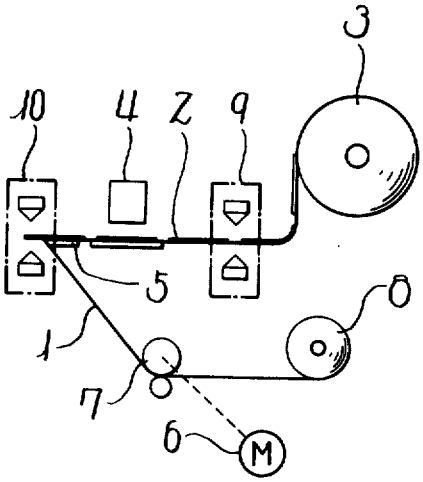
Fig. 1 PRIOR ART
FIG. 1 is a side view of the conventional label feed control system.
Figure 2:
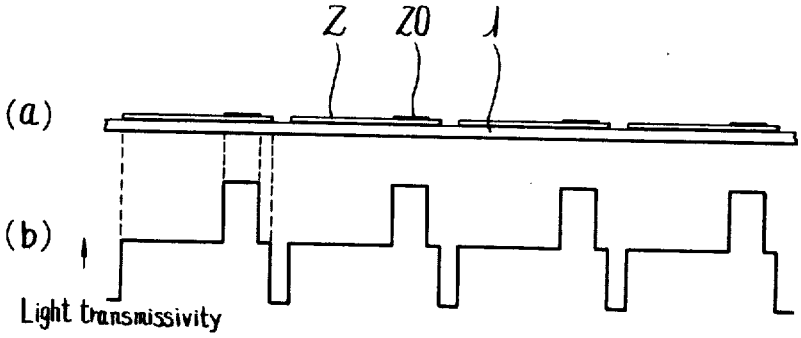
Fig. 2 PRIOR ART
FIG. 2-*a* is a side view of the base ribbon with labels stuck thereon, and FIG. 2-*b* is a chart showing the light transmissivity of the labeled ribbon.
Figure 3:
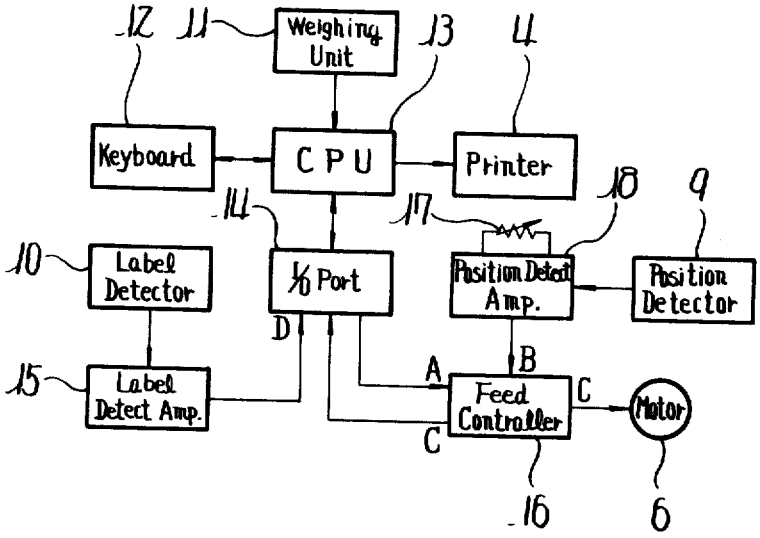
Fig. 3 PRIOR ART
FIG. 3 is a block diagram of the system shown in FIG. 1.
Figure 4:
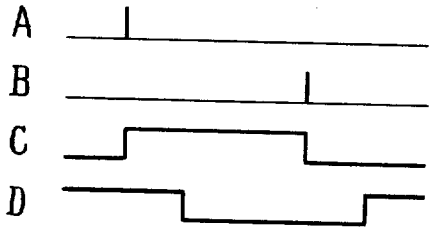
Fig. 4 PRIOR ART
FIG. 4 is a timing chart for the system of FIG. 3.
Figure 5:
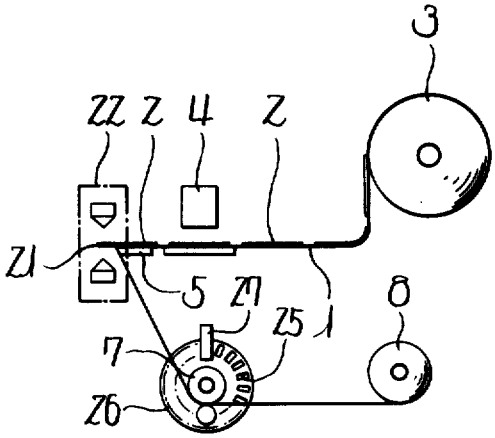
FIG. 5 is a side view of the first embodiment of the present invention.
Figure 6:
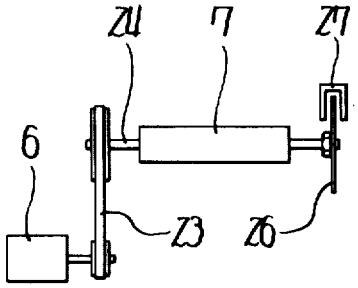
FIG. 6 is a rear view of the feed roller section of the system shown in FIG. 5.
Figure 7:
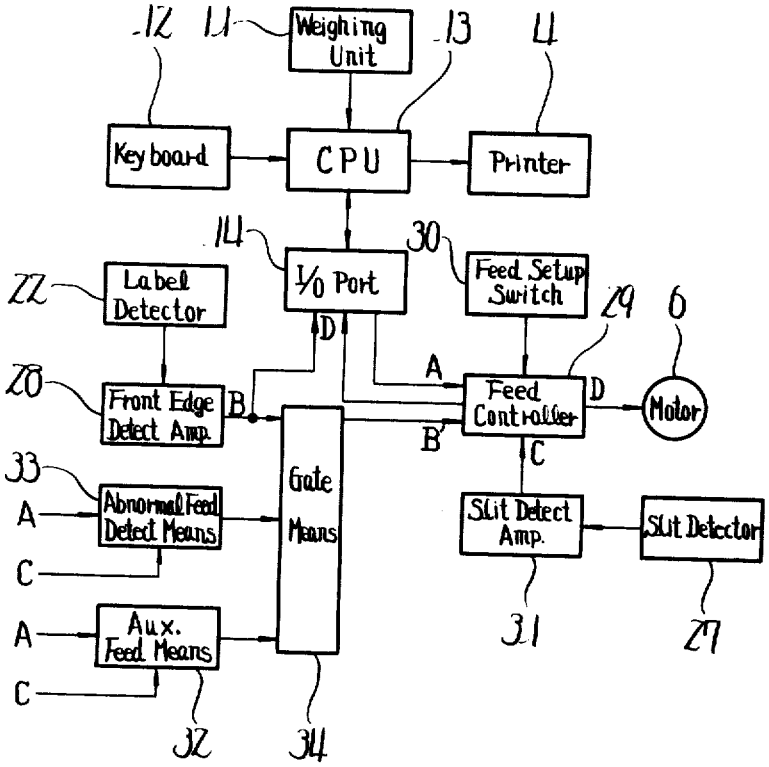
FIG. 7 is a block diagram of the first embodiment system.

The first embodiment of the present invention will now be described with reference to FIGS. 5 through 12, in which the same reference numbers are used for the identical portions shown in FIGS. 1 through 4 and the explanation thereof will be omitted. In this embodiment, a label detector 22 is provided for detecting that the front edge 21 of a label 2 has reached the front of a separator 5 during transportation of the base ribbon 1, and also for detecting the presence of the label 2. On a shaft 24 of a feed roller 7 driven by an induction motor 6 and a belt 23, there is mounted a slit disk 26 with many slits 25 provided on the circumference thereof. Confronting the slit disk 26, there is provided a slit detector 27 for sensing the slits 25.

An I/O port 14 is connected to a CPU 13, and further connected to the label detector 22 through a front edge detection amplifier 28. The I/O port 14 is further connected to a feed controller 29, to which the motor 6 is connected. The feed controller 29 is connected to a feed amount setup unit 30 such as a digital switch, and further connected to the slit detector 27 through a slit detection amplifier 31.

There is provided an auxiliary feed means 32 which has a setup for the standard feed amount LA that corresponds to a feed amount of the ribbon after it starts moving until the front edge 21 of the label 2 is detected in normal transportation, and operates to count signals from the slit detection amplifier 31 in response to a feed start signal A from the I/O port 14. There is further provided an abnormal feed detection means 33 which has a setup for the abnormal detection feed amount LB that is smaller than the standard feed amount LA, and operates to count signals from the slit detection amplifier 31 in response to the feed start signal A. The abnormal feed detection means 33 completes the count operation faster than the auxiliary feed means 32. A gate means 34 is provided such that if the label detector 22 produces a label detection signal B after the abnormal feed detection means 33 has completed the count operation, the signal B is directly supplied to the feed controller 29 as signal B', or if the label detector 22 produces a label detection signal B during the count operation of the abnormal feed detection means 33, the signal B is supplied to the feed controller 29 as signal B' when the auxiliary feed means 32 has completed the count operation.

In normal operation, the signal B is high when the label 2 is absent from the label detector 22. If the CPU 13 generates a signal A while the signal B is high, the feed controller 29 produces a high D-signal so that the motor 6 operates to feed the ribbon 1. The signal D is also delivered to the CPU 13 so as to inhibit other operations during the feed operation. As the ribbon 1 is transported, the label 2 is peeled off the ribbon, projecting over the separator 5, and ultimately the front edge 21 of the label 2 is detected by the label detector 22. Then, the signal B from the front edge detection amplifier 28 goes low. At this time, the abnormal feed detection means 33 has completed the count operation, and the signal B is directly sent as signal B' through the gate means 34 to the feed controller 29, which in turn starts to count signals C from the slit detector 27. When the count reaches a number which has been preset on the feed amount setup switch 30, the signal D goes low to stop the motor 6. Accordingly, the label 2 is stopped following a certain amount of transportation after its front edge 21 has been detected by the label detector 22. In this arrangement, the reference signal is created by the detection of the front edge 21 which provides a large transmissivity difference so far as the label 2 is not transparent and also independence from the printed portion 20 of the label 2, thus resulting in a very accurate detection.

The signal B stays low unless the label 2 is removed, holding the signal A from being generated. Thus, other operations are held and double issuing of the label 2 does not occur. Accordingly, the label detector 22 also serves as a detector for sensing the presence of a label as in the case of the conventional system.

By the way, if the operator puts his finger into the label detector 22 before the front edge 21 of the label 2 has reached the label detector 22, the signal B goes low as in detecting the front edge. At this time, however, since the abnormal feed detection means 33 is counting and the label 2 has not yet traveled for the abnormal detection feed amount LB, the signal B is invalidated by the gate means 34 and control is switched to the label feed by the standard feed amount LA. After the auxiliary feed means 32 has completed the count operation and the label 2 has traveled for the standard feed amount LA, the front edge detection is recognized. Then, the gate means 34 issues the signal B', causing the feed controller 29 to feed the ribbon for the constant length. Thus, even if the label detector 22 operates erroneously due to the insertion of the operator's finger, control is switched to the label feed by the standard feed amount LA, resulting in a reduction of the label positioning error.

Figure 8:
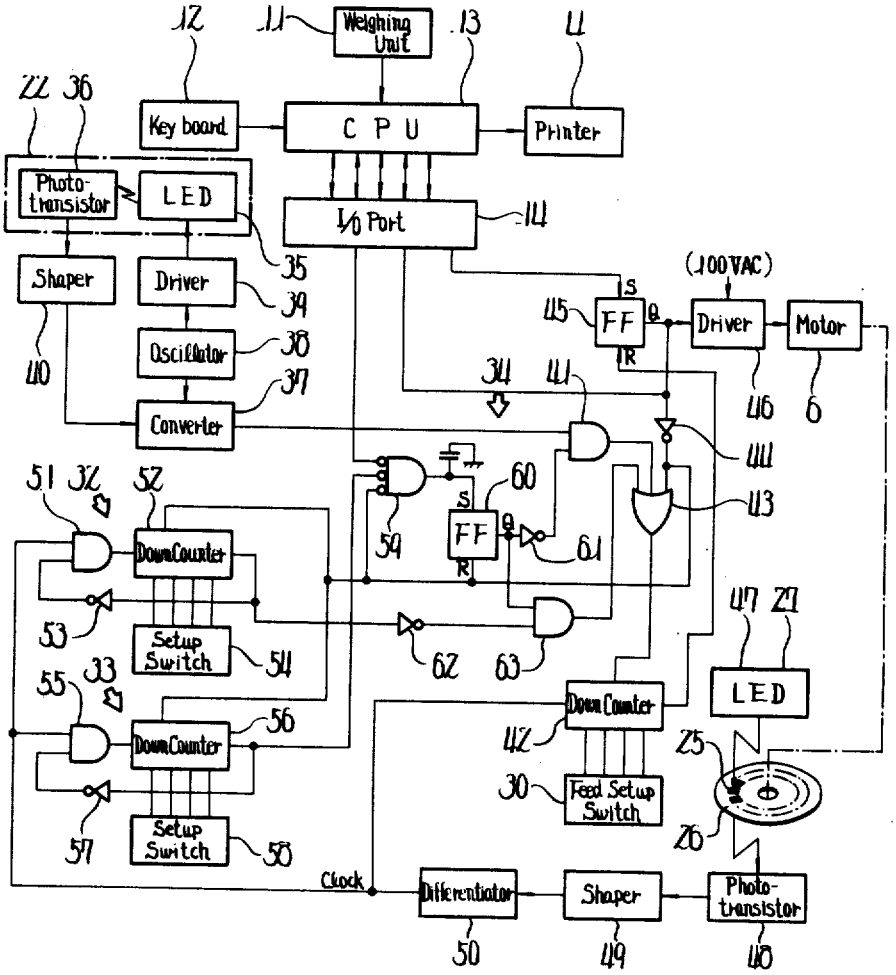
FIG. 8 is a detailed block diagram based on FIG. 7.

The first embodiment of the invention will further be explained in detail with reference to FIG. 8. FIG. 8 merely particularizes the blocks of FIG. 7, and there is no difference in the basic operation. The label detector 22 consists of a light emitting diode (LED) 35 and a photo-transistor 36, and the LED 35 is connected through a driver 36 to an oscillator 38 which is connected to a converter 37. The photo-transistor 36 is connected through a waveform shaper 40 to the converter 37. The oscillator 38 oscillates in a frequency of about 3 kHz so that the LED 35 emits light pulses periodically. The converter 37 converts the pulse output from the photo-transistor 36 into a DC voltage signal having a high and low levels. The output of the converter 37 goes high when the label is absent, and goes low when the label exists. The purpose of using such flushing light in detecting the label is to prevent the effect of external light and also to obtain an intensified light from the LED 35 which is located far from the photo-transistor 36, so as to enhance the reliability of the detection.

The converter 37 is connected to the I/O port 14 and to an AND gate 41 which is connected through an OR gate 43 to a down-counter 42, a principal constituent of a means for feeding the ribbon at a constant pitch. The down-counter 42 is connected to the feed amount setup switch 30. Another input of the OR gate 43 is connected to an inverter 44, the input of which is connected to the I/O port 14 and to the output Q of a flip-flop 45. The set and reset inputs of the flip-flop 45 are connected to the I/O port 14 and the down-counter 42, respectively. The output of the flip-flop 45 is connected through a driver 42 to the motor 6.

The slit detector 27 confronting a slit disk 26 consists of an LED 47 and a photo-transistor 48, and the photo-transistor 48 is connected through a waveform shaper 49 to a differentiator 50 which differentiates the rise and fall transitions of input pulses to produce pulses twice the original pulses derived from the slits 25. The differentiator 50 is connected to the down-counter 42. Also connected to the differentiator 50 through an AND gate 51 and supplied with a load signal from the inverter 44 is a down-counter 52 which constitutes the principal part of the auxiliary feed means 32. The output of the down-counter 52 is connected through an inverter 53 to the input of the AND gate 51. The down-counter 52 is also connected to a setup switch 54 for setting the standard feed amount LA. Similarly, there is provided a down-counter 56, the principal constituent of the abnormal feed detection means 33, which is supplied with a load signal from the inverter 44 and connected through an AND gate 55 to the differentiator 50. The output of the down-counter 56 is connected through an inverter 57 to the input of the AND gate 55. The down-counter 56 is also connected to a setup switch 58 for setting the abnormality detection feed amount LB. A NAND gate 59 is provided to receive the signals from the converter 37, inverter 44 and down-counter 56, and its output is connected to the set input of a flip-flop 60. The output Q of the flip-flop 60 is connected through an inverter 61 to the input of the AND gate 41. An AND gate 63 is provided to receive a signal from the output Q of the flip-flop 60 and also a signal derived from the down-counter 52 but inverted by an inverter 62, and its output is connected to the input of the OR gate 43.

Figure 9:
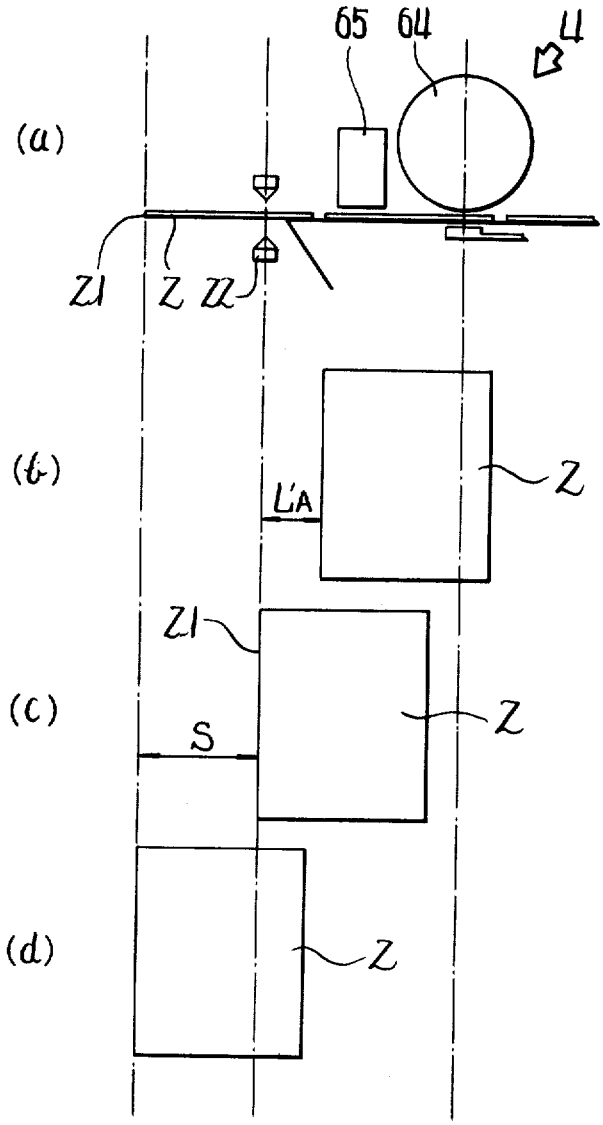
FIG. 9 is an illustration showing the normal label feed.

The feed amount setup switch 30 is set to the number of pulses corresponding to the constant feed amount S shown in FIG. 9, whereas the setup switch 54 is set to the number of pulses corresponding to the standard feed amount LA which is the distance for the label to travel after the feed has started as shown in FIG. 9-*b* until its front edge is detected as shown in FIG. 9-*c*. The setup switch 58 is set to the number of pulses corresponding to the abnormality detection feed amount LB which is less than the standard feed amount LA by the value obtained by way of experiment in consideration of the pitch error of the motor 6 and the dimensional error of the label 2. That is to say, assuming the feed amount in printing label to be LA' as shown in FIGS. 9-*b* and 9-*c*, the LA' has a value in the range of $LA \pm \alpha$ (where $\alpha$ is the error), and these setup values are determined so as to meet $LA - \alpha > LB$.

Figure 11:
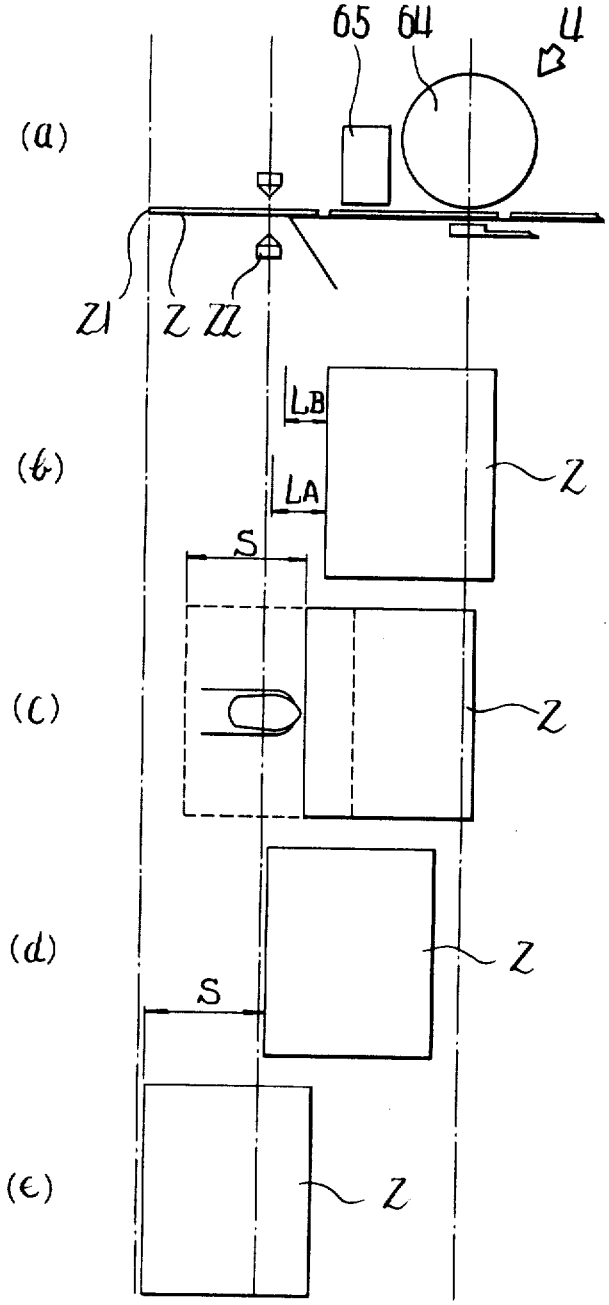
FIG. 11 is an illustration showing the abnormal label feed.

In FIGS. 9 and 11, a printer 4 consists of a data printing unit 64 such as a line printer and a commodity stamp 65.

Figure 10:
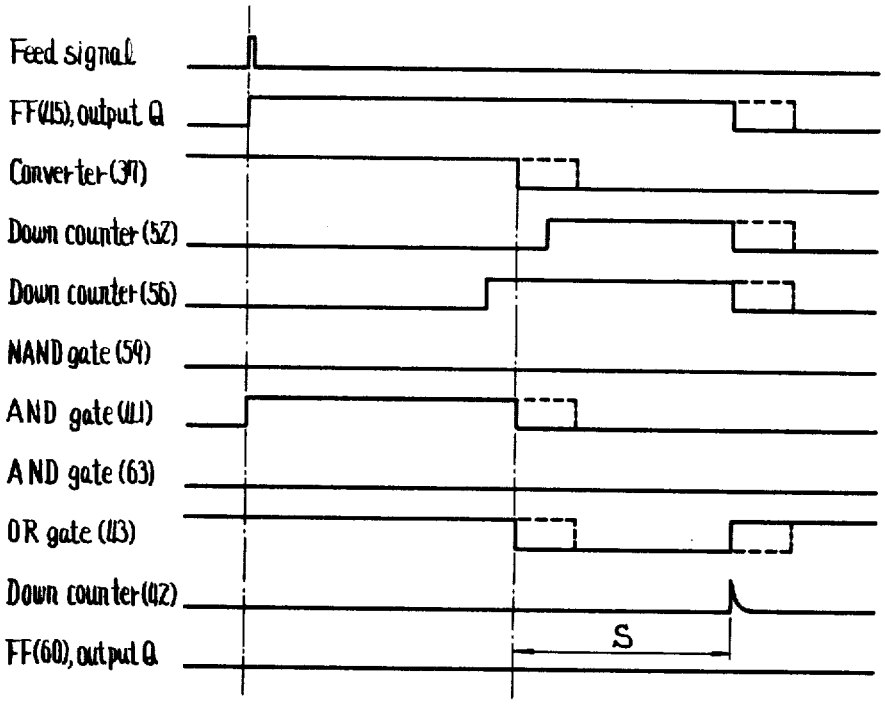
FIG. 10 is a timing chart showing the operation of FIG. 9.

In the state shown in FIG. 9-*a*, when the label 2 has been removed and is absent from the label detector 22, or when the flip-flop 45 is in the reset state, the OR gate 43 outputs a high level to load the down-counter 42 with the contents of the feed amount setup switch 30. This operation may be considered as presetting, since the down-counter 42 is loaded irrespective of its initial contents when a high level is given by the OR gate 43. In this state, when the flip-flop 45 receives a feed signal from the I/O port 14, it is set as shown in FIG. 10, causing the inverter 44 to output a low level and, at the same time, the driver 46 to supply the power of 100 VAC to the motor 6. Then, the motor 6 rotates to feed the ribbon 1 and the rotating slit disk 26 causes the photo-transistor 48 to emit pulses which in turn are supplied to the down-counter 42 as a clock signal. The down-counter 42, however, does not change its contents, because it still receives a high level through the AND gate 41 due to a high level output from the converter 37. When the feed operation is started, the low output of the inverter 44 releases the down-counters 52 and 56 from loading, and they start to count down in response to the input pulses from the photo-transistor 48.

When the label 2 comes to the position shown in FIG. 9-*c*, the front edge 21 is detected by the label detector 22, and the output of the converter 37 goes low. At this point the down-counter 56 has completed the count down for the abnormality detection feed amount LB, and its "0" output inhibits the NAND gate 59. Accordingly, the flip-flop 60 is not set and the AND gate 63 keeps the output low. The output of the AND gate 41 goes low and the down-counter 42 is released from loading. That is to say, when the down-counter 42 receives pulses from the slit detector 27 after the output of the converter 37 has turned to low, it is counted down and the flip-flop 45 is reset when the contents reaches zero. Then, the motor 6 is stopped and the down-counters 42, 52 and 56 are loaded again.

After the front edge 21 of the label 2 has been detected at the position of FIG. 9-*c*, the ribbon 1 is transported for the length S to the position shown in FIG. 9-*d*, then it is stopped. FIGS. 9-*b* through 9-*d* show the normal transportation of the label 2, and FIG. 10 shows the timing of the signals during the operation.

Figure 12:
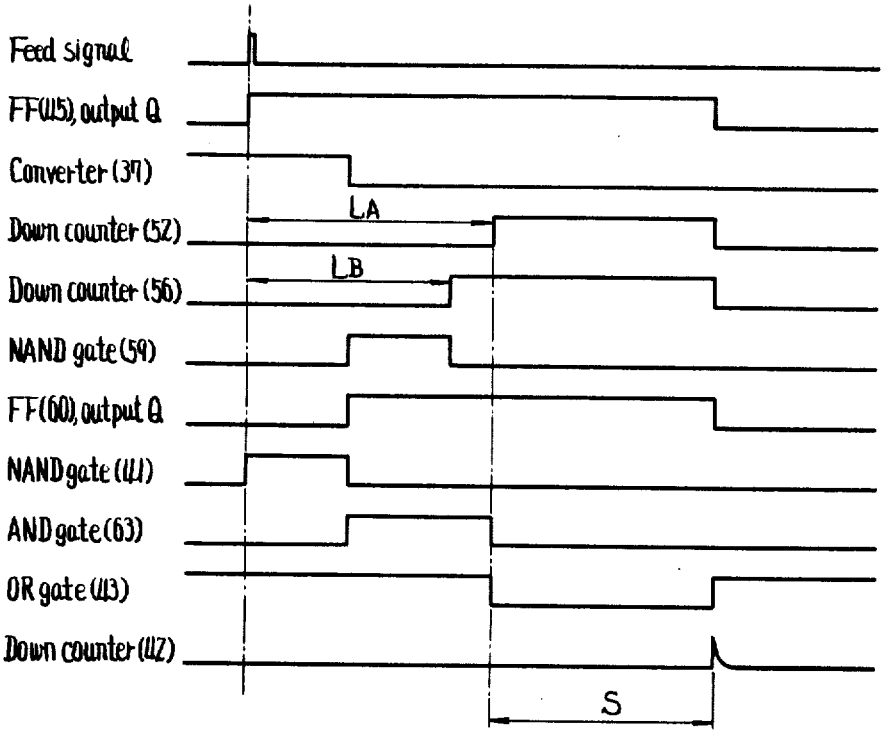
FIG. 12 is a timing chart showing the operation of FIG. 11.
Figure 13:
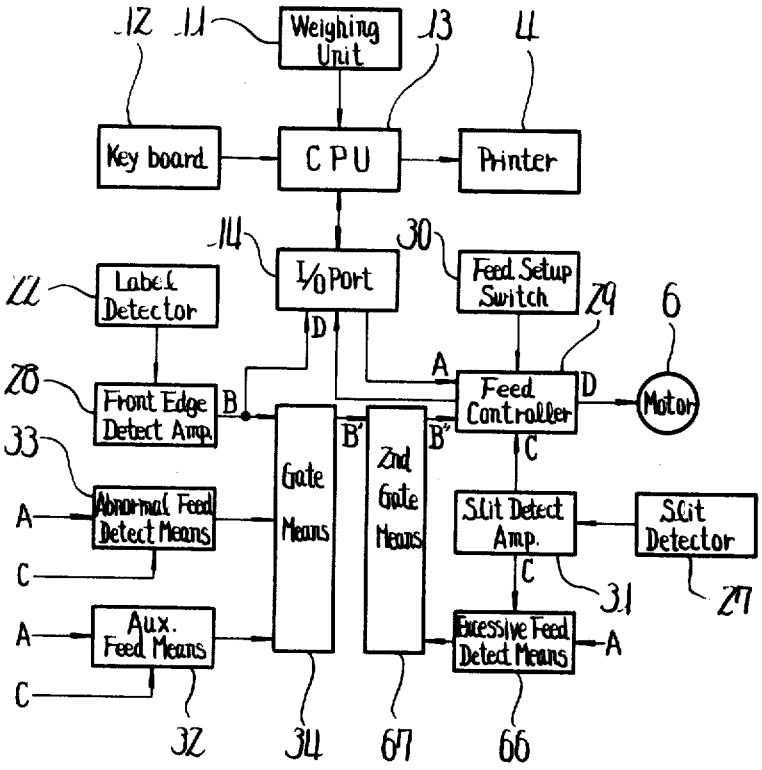
FIG. 13 is a block diagram showing the second embodiment of the present invention.

In the arrangement, when the transportation of the ribbon 1 has been started at the position shown in FIG. 11-*b*, and if the operator puts his finger into the label detector 22 at the label position shown in FIG. 11-c, the label detector 22 responds to this action even though the front edge 21 of the label 2 does not reach the detector, causing the converter 37 to output a low level. At this time, however, since the down-counter 56 is counting down and the label is not yet fed for the abnormal detection feed amount LB, the NAND gate 59 outputs a high level to set the flip-flop 60. Then, the output of the AND gate 63 goes high and the down-counter 42 is not released from loading. Thus, transportation of the ribbon continues without being controlled by the down-counter 42. At the same time, the down-counter 52 continues to count down, and when it becomes empty the AND gate 63 outputs a low level to release the down-counter 42 from loading. Then, the label 2 is transported from the feed start position shown in FIG. 11-b to the position shown in FIG. 11-d for the standard feed amount LA, and the front edge detection is recognized. From this position, the label is transported for the constant length S under control of the down-counter 42. If the present embodiment were not employed, the label would be transported for the length S as shown by the dotted line in FIG. 11-c, resulting in a large positioning error. According to this embodiment, the label is transported for the length S from the position which deviates less distance from the normal front edge detecting position, resulting in a less effect on the positioning of the succeeding label to be printed. FIG. 12 shows the timing of the signals during the operation.

Whereas the above embodiment employs the down-counters 42, 52 and 56, they may be replaced with much inexpensive up-counters, so that respective positions are determined by use of comparators which compare the contents of the up-counters with the setup switches 30, 54 and 56.

The second embodiment of the present invention will now be described with reference to FIGS. 13 through 16, in which the same reference numbers are used for the identical portions in the previous figures and the explanation thereof will be omitted. In this embodiment, there is provided an excessive feed detection means 66 which is set to an excess detection feed amount LC that is larger than the standard feed amount LA, and adapted to count signals from the slit detection amplifier 31 in response to the feed start signal A. There is also provided a second gate means 67 at the front stage of the feed controller 29 for controlling the output B from the front edge detection amplifier 28 in accordance with the output of the excessive feed detection means 66.

Figure 14:
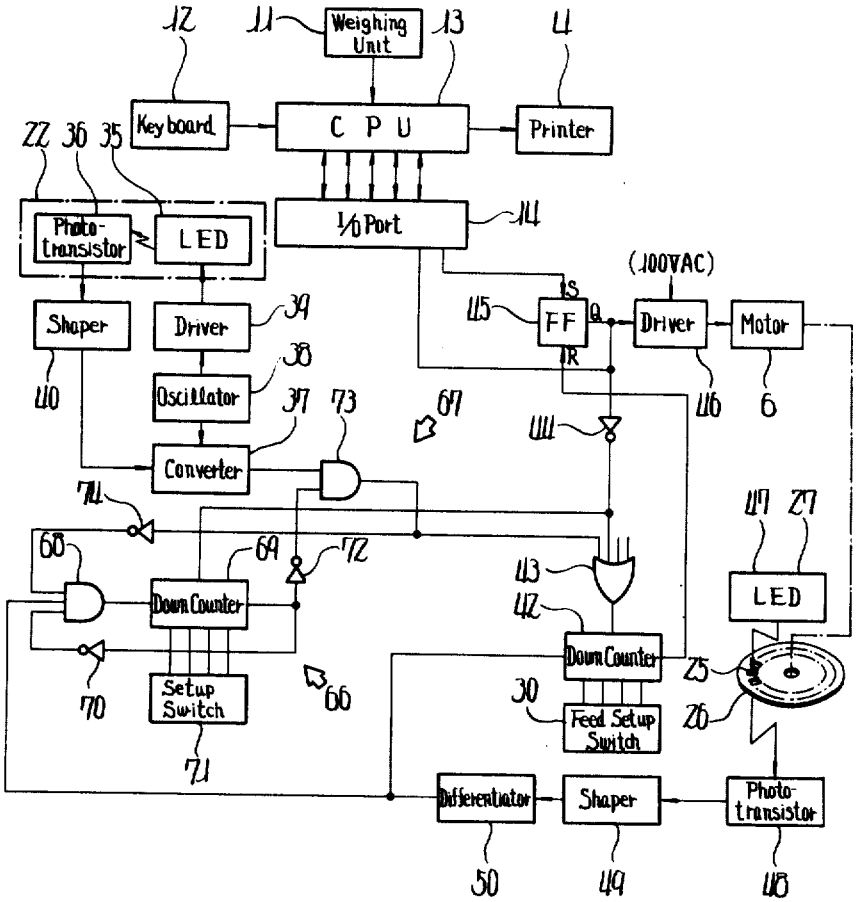
FIG. 14 is a detailed block diagram based on FIG. 13.

In particular, as shown in FIG. 14 which is derived from FIG. 8 but the auxiliary feed means 32, abnormal feed detection means 33 and the most of the gate means 34 are omitted therefrom, there is provided a down-counter 69, the principal constituent of the excessive feed detection means 66, which is supplied with a load signal from the inverter 44 and connected through an AND gate 68 to the differentiator 50. The output of the down-counter 69 is connected through an inverter 70 to the input of the AND gate 68. The down-counter 69 is connected to a setup switch 71 for setting the excess detection feed amount LC. An AND gate 73 is the principal constituent of the second gate means 67, having an input supplied from the down-counter 69 through an inverter 72 and another input supplied from the converter 37. The output of the AND gate 73 is delivered to the OR gate 43 and also to the AND gate 68 through an inverter 74.

The excess detection feed amount LC is set to a number of pulses which is larger than the standard feed amount LA by the amount determined by way of experiment in consideration of the pitch error of the motor 6 and the dimensional error of the label 2, and in the case of determining the abnormality detection feed amount LB.

Figure 15:
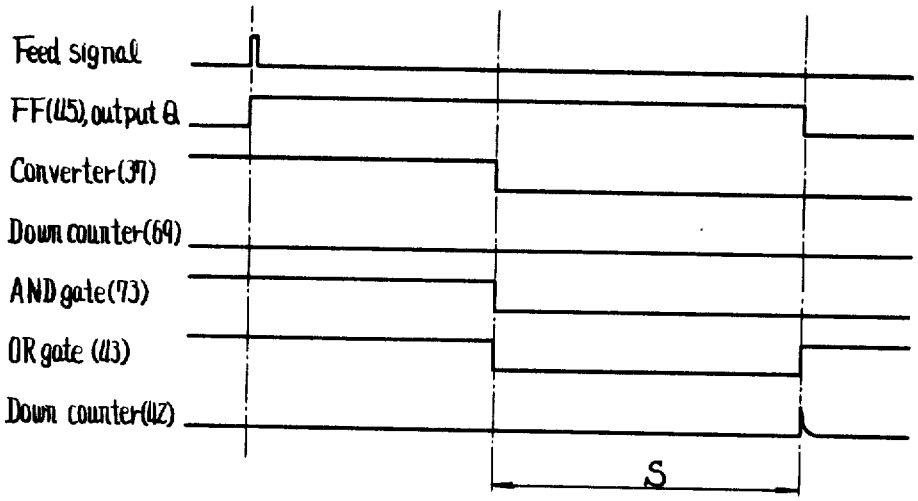
FIG. 15 is a timing chart showing the normal label feed by the system of FIG. 14.

In this arrangement, when a feed signal is issued from the I/O port 14, the flip-flop 45 is set to activate the motor 6, and the ribbon 1 is transported. When the front edge 21 of the label 2 is detected, the converter 37 outputs a low level, causing the down-counter 42 to carry out the constant pitch transportation. (See FIG. 8) During this operation, the down-counter 69 is counting down the contents in response to pulses from the phototransistor 48. However, the output of the AND gate 73 goes low in response to the detection of the front edge 21, and the down-counter 69 is not affected. Thus, the label 2 is printed normally. FIG. 15 shows the timing of the signals during for this operation.

Figure 16:
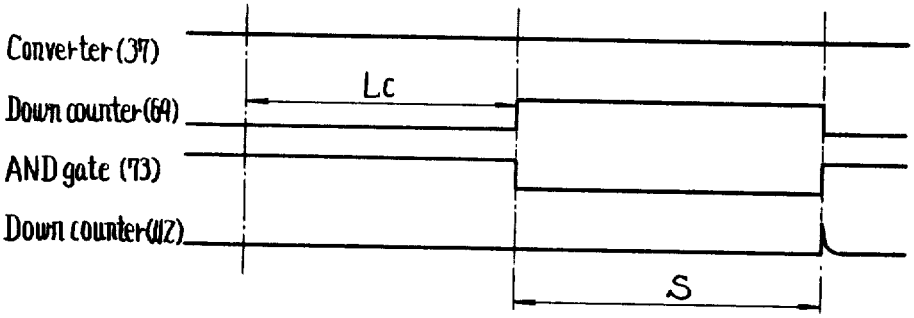
FIG. 16 is a timing chart showing the excessive label feed.
Figure 17:
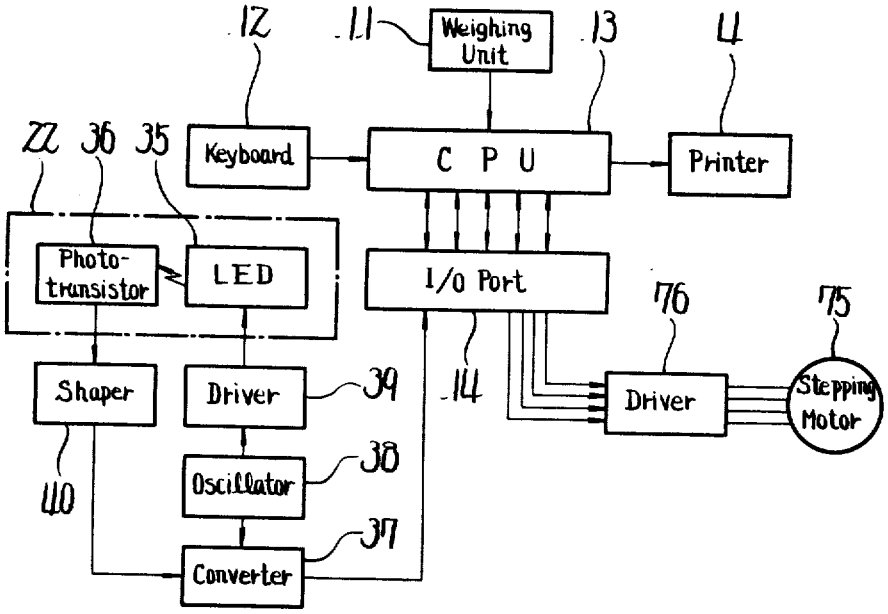
FIG. 17 is a block diagram of the third embodiment of the present invention.

Suppose that after the transportation of the ribbon 1 is started by the feed signal, the front edge 21 of the label 2 reaches the label detector 22, but it fails to produce the detection signal due to malfunctioning. In this case, the converter 37 keeps its output high and does not control the down-counter 42. On the other hand, the down-counter 69 has been counting down the excess detection feed amount LC since the transportation of the ribbon was started, and it outputs a high level to inhibit the AND gate 73 when it becomes empty. Then, the down-counter 42 is released from loading, and from this moment the label is transported for the constant length S under control of the down-counter 42. Accordingly, waste of labels 2 by uncontrollable running due to a high output of the converter 37 can be prevented. Thus, even if the label detector 22 does not operate, the excessive feed can be limited to the value which is the difference between the normal front edge detecting position and the excess detection feed amount LC. FIG. 16 shows the timing of the signals during this operation.

Figure 18:
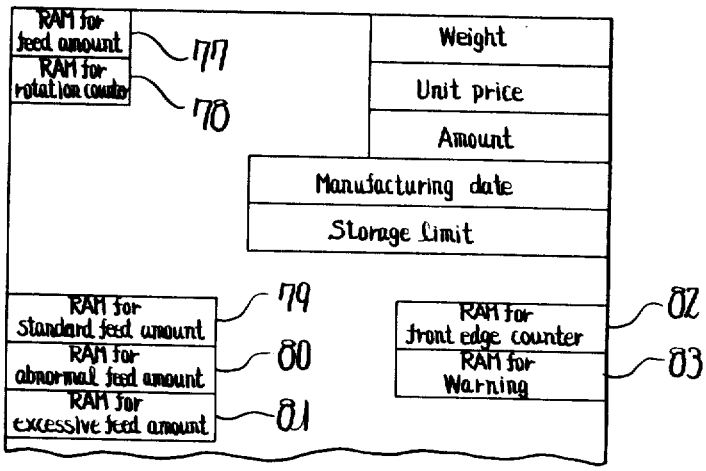
FIG. 18 is an illustration showing the RAM map of the system.

The third embodiment of the invention will be described with reference to FIGS. 17 through 21, wherein a stepping motor 75 is employed as a drive actuator which operates in program control. The converter 37 is connected to the I/O port 14 which is connected to the CPU 13. The label detector 22 is connected to the converter 37. The stepping motor 75 is connected through a driver 76 to the I/O port 14. As shown in FIG. 18, the CPU 13 has RAMs which include a feed amount RAM 77, a rotation counter RAM 78, a standard feed amount RAM 77, an abnormality detection feed amount RAM 80, an excess detection feed amount RAM 81, a front edge counter RAM 82, and a warning RAM 83.

Figure 19:
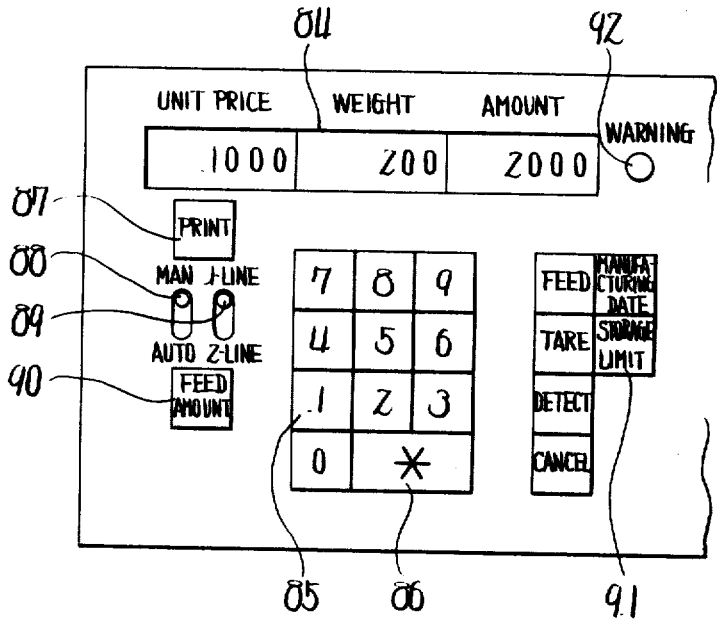
FIG. 19 is a plan view of the keyboard.

FIG. 19 shows the layout of the keyboard, which includes a read out unit 84 divided into UNIT PRICE, WEIGHT and AMOUNT, a ten-key 85 for entering numeric data, an EXECUTION key 86, a PRINT key 87, a MAN/AUTO mode selector switch 88, a 1-LINE/2-LINE print mode selector switch 89, and a FEED AMOUNT key 90. The keyboard is further provided with the function keys 91 including a FEED key, a WARE key, a DETECTION amount setup key, a MANUFACTURING DATE setup key, a STORAGE LIMIT setup key, and a CANCEL key. There is further provided an abnormality WARNING lamp 92.

Figure 20:
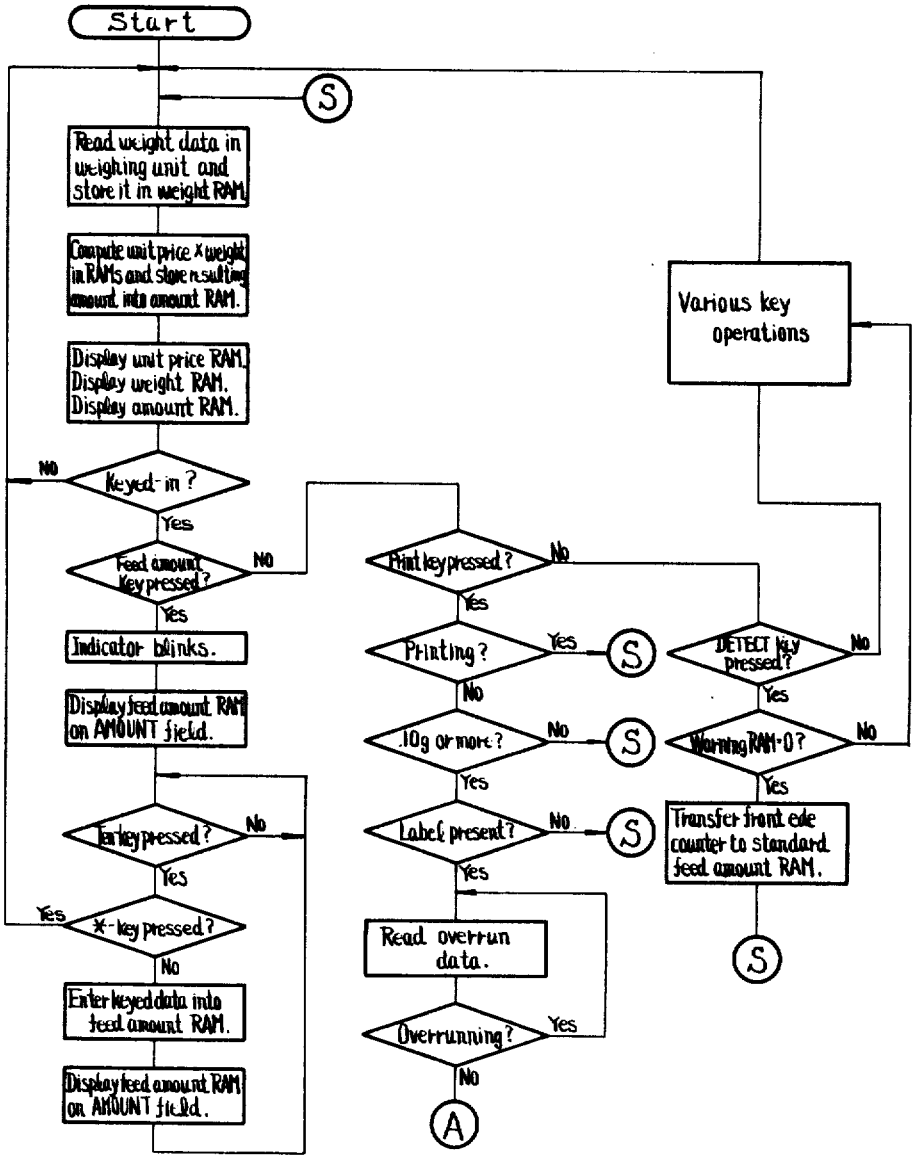
FIGS. 20 and 21 are flowchart of operation of the third embodiment system.

On the flowchart of FIG. 20, when the system starts, a weight data derived from the weighing unit 11 is loaded into the weight RAM. The weight data is multiplied with the contents of the unit price RAM which has been preset, and the result is stored in the amount RAM. The contents of the unit price RAM, weight RAM and amount RAM are displayed on the respective fields of the read out unit 84. Then, the setup of the operational modes such as the MAN/AUTO mode are checked. After entry for these keys has been confirmed, entry of the FEED AMOUNT key 90 is checked.

Entry of the FEED AMOUNT key 90 sets the feed amount S in which the label 2 travels after its front edge has been detected by the label detector 22. When the FEED AMOUNT key 90 is pressed, the read out unit 84 is turned off, and the contents of the feed amount RAM 77 are displayed in the AMOUNT field of the read out unit 84. This is an old data, and by using the ten-key 85 a new data is entered into the feed amount RAM 77 and displayed on the read out unit 84 for confirmation. By pressing the EXECUTION key 86, the feed amount S is set, and the unit price, weight and amount are displayed again on the read out unit 84.

After the feed amount has been set or the previous setting is not changed, the system operates according to the key entry. Suppose the DETECTION amount setup key is pressed with the contents of the warning RAM 83 being "0", the contents of the front edge counter 82, which measures the distance from the position at which transportation has started to the position at which the front edge 21 of the label 2 is detected, are stored in the standard feed amount RAM 79 so as to set the standard feed amount LA. If the contents of the warning RAM 83 are not "0", the DETECTION amount setup key has no effect, and control returns to point S. When the PRINT key 87 is pressed, it is checked if printing is being carried out. During printing, control returns to point S, or if not, the weight data is checked if it is 10 grams or more. This checking verifies if a commodity is surely loaded to the weighing unit 11, and at the same time, various checks for the weighing unit, such as the overflow of the amount are carried out. Next, the label detector 22 checks the presence of the label. If the label is detected, control returns to point S in order to prevent the double issue of the label, and if not, overrun data is read in. The overrun data is not obtained by the circuit of FIG. 17, but provided by an overrun detecting device which is not shown in the figure. During the overrun, the system waits for the end of overrun, then control proceeds to point A on the flowchart.

Figure 21:
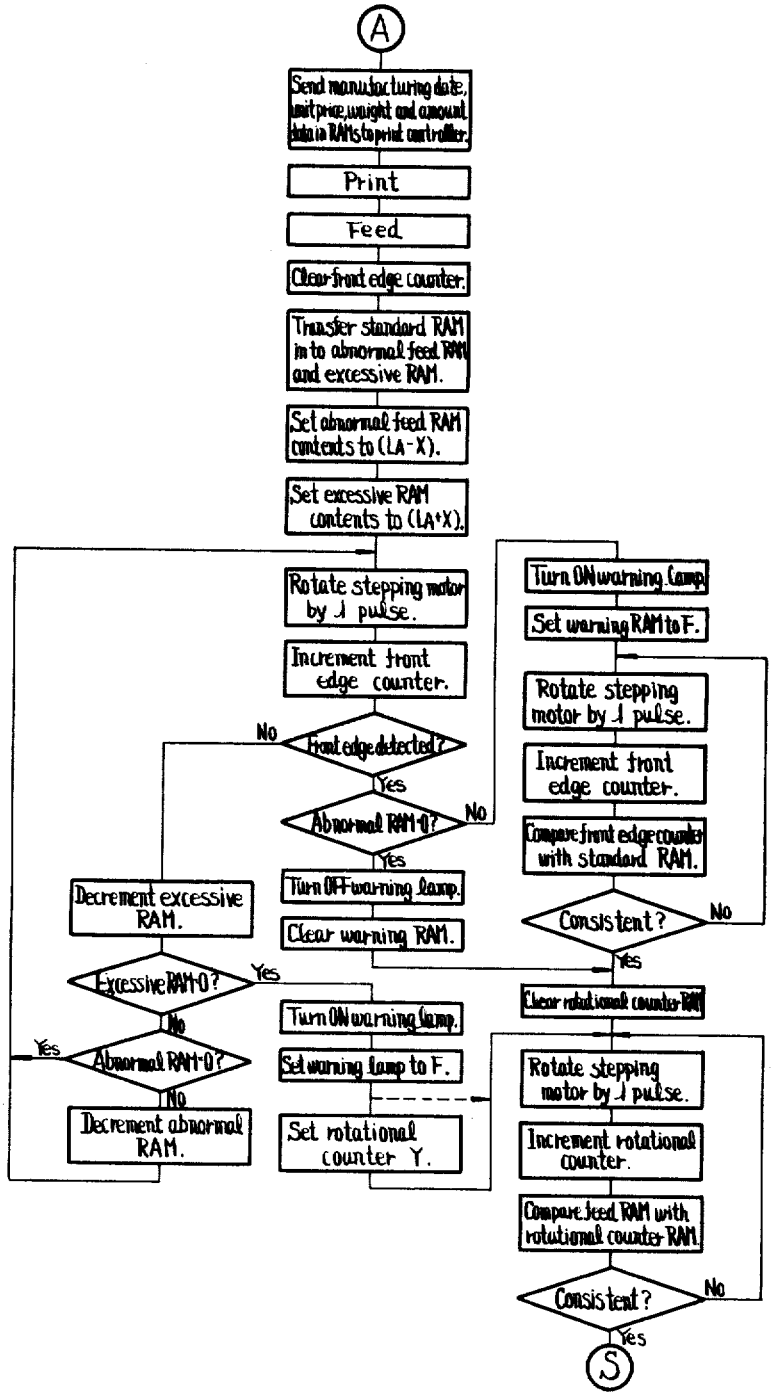
Figure 22:
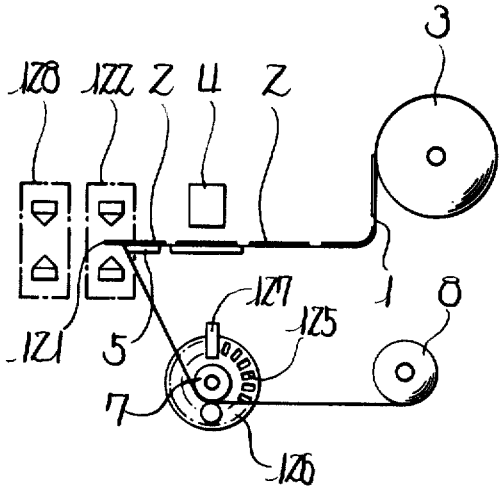
FIG. 22 is a side view of the fourth embodiment of the present invention.
Figure 23:
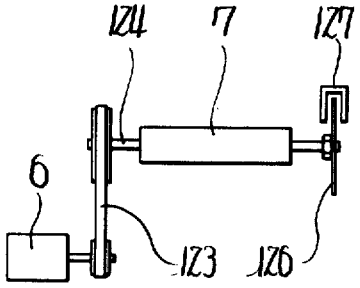
FIG. 23 is a rear view of the feed roller section of FIG. 22.
Figure 24:
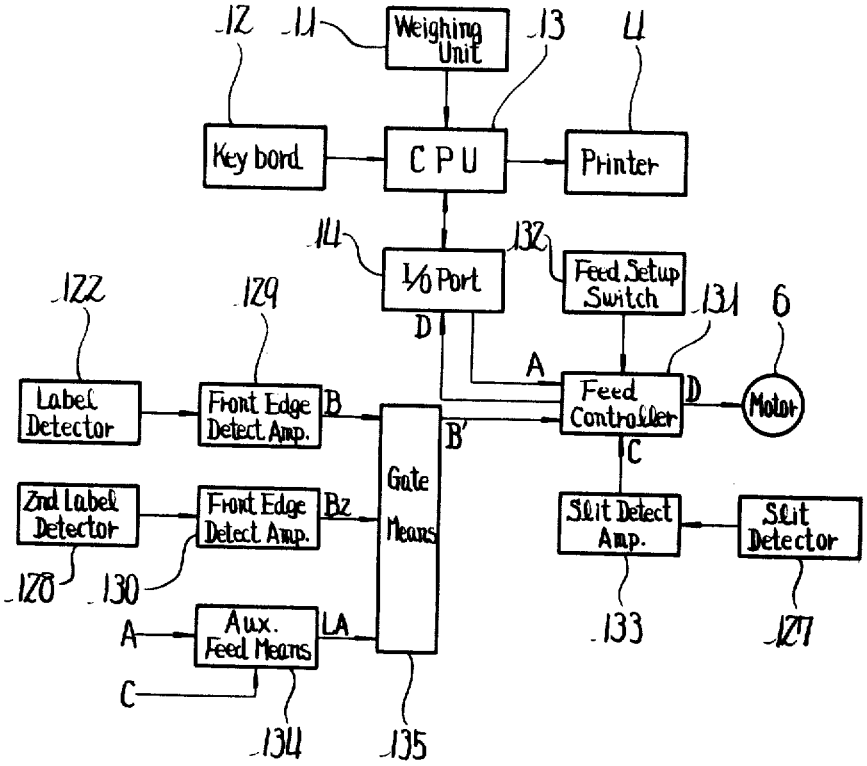
FIG. 24 is a block diagram of the fourth embodiment system.

From point A, the process continues as shown on the flowchart of FIG. 21. The contents of the manufacturing date, unit price, weight and amount RAMs are transferred to the print controller, then printed by the printer 4. When the transportation of the ribbon 1 is started, the front edge counter RAM 82 is cleared, and the contents of the standard feed amount RAM 79 are transferred to the abnormality detection feed amount RAM 80 and the excess detection feed amount RAM 81. The abnormality detection feed amount RAM 80 is set to the abnormality detection feed amount LB obtained by subtracting the standard feed amount LA by X (where X is a constant value), and the excess detection feed amount RAM 81 is set to the excess detection feed amount LC obtained by adding the standard feed amount LA to Y (where Y is a constant value). After that, the stepping motor 75 is rotated by one pulse and it is counted by the front edge counter RAM 82. It is checked if the front edge 21 of the label 2 is detected by the label detector 22, and if it is not detected, the excess detection feed amount RAM 81 is decremented by 1. If the contents of the RAM 81 has not reached zero, the contents of the abnormality detection feed amount RAM 80 is checked. If the contents of the RAM 80 are not zero, it is decremented by 1 and the stepping motor 75 is rotated by one pitch. This operation continues until the label detector 22 detects the front edge 21 of the label 2. The stepping motor 75 steps rotating to feed the label 2, and when the label detector 22 detects the front edge 21, the abnormality detection feed amount RAM 80 is checked for zero. If it is zero the abnormality WARNING lamp 92 is off, and the warning RAM 83 becomes empty to clear the rotation counter RAM 78. The stepping motor 75 rotates by one pulse, causing the rotation counter RAM 78 to be incremented by 1, which is then compared with the contents of the feed amount RAM 77. The feed amount RAM 77 has been preset to a constant value as mentioned previously. The rotation counter RAM 78 is incremented continuously until the contents of the RAMs coincide. When the contents of the RAMs coincide, the stepping motor 75 stops, and control returns to the beginning.

If the contents of the abnormality detection feed amount RAM 80 has not reached zero when the front edge is detected, the WARNING lamp 92 lights up and the flag is set in the warning RAM 83. The stepping motor 75 rotates by one pulse and the front edge counter RAM 82 is incremented by 1. The RAM 82 and the standard feed amount RAM 79 are compared, and the above operation is repeated until they coincide. When the contents of the RAMs coincide, the rotation counter RAM 78 is incremented by 1 as in the case of the normal operation and compared with the contents of the feed amount RAM 77. When the contents of the RAMs coincide, the stepping motor 75 stops and control returns to the beginning.

Before the label detector 22 detects the front edge 21 of the label 2, when the decrementing excess detection feed amount RAM 81 becomes empty, the WARNING lamp 92 lights and the flag is set in the warning RAM 83. The rotation counter RAM 78 is set to Y and the stepping motor 75 rotates by one pulse. The rotation counter RAM 78 is incremented by 1 and compared with the contents of the feed amount RAM 77. Accordingly, the contents of the RAMs coincide after S−Y pulses have been processed. Then, the stepping motor 75 stops and control returns to the beginning. In this case, the label is fed for LA+Y pulses before the excess detection feed amount RAM 81 becomes empty and, after that, for more S−Y pulses. Thus, the label is fed for a total of LA+S pulses. The process of setting the rotation counter 78 to Y may be bypassed as shown by the dotted line in FIG. 21.

The fourth embodiment of the invention will be described with reference to FIGS. 22 through 29, in which the same reference number are used for the identical portions shown in FIGS. 1 through 4 and the explanation thereof will be omitted. A label detector 122 is provided for detecting that the front edge 121 of a label 2 has reached the front of a separator 5 during the transportation of a base ribbon 1, and also for detecting the presence of a label 2. On a shaft 124 of a feed roller 7 driven by an induction motor 6 and a belt 123, there is mounted a slit disk 126 with many slits 125 provided on the circumference thereof. Confronting the slit disk 126, there is provided a slit detector 127 for sensing the slits 125. There is further provided a second label detector 128 located downstream of the label detector 122. The second label detector 128 has the same detecting capability as that of the label detector 122.

The label detector 122 and the second label detector 128 are connected to front edge detection amplifiers 129 and 130, respectively. An I/O port 14 is connected to a CPU 13, and further connected to a feed controller 131 which is connected to the motor 6. The feed controller 131 is connected to a feed amount setup unit 132 such as a digital switch, and further connected to the slit detector 127 through a slit detection amplifier 133. There is provided an auxiliary feed means 134 which has a setup for the standard feed amount LA that corresponds to a feed amount of the ribbon after it starts moving until the front edge 121 of the label 2 is detected in the normal transportation, and operates to count signals from the slit detection amplifier 133 in response to a feed start signal A from the I/O port 14. There is further provided a gate means 135 which has the inputs connected to the front edge detection amplifiers 129 and 130 and also to the auxiliary feed means 134, and operated to conduct a front edge detection signal to the feed controller 131 if the front edge detection amplifier 129 first issues a front edge detection signal, and operates to conduct the signal to the feed controller 131 after the auxiliary feed means 134 has completed the count operation if the front edge detection amplifier 130 issues a front edge detection signal earlier than the front edge detection amplifier 129.

In normal operation, when the label 2 is absent from the label detector 122, signal B is at a high level. If the CPU 13 generates a signal A while the signal B is high, the feed controller 131 produces a high D-signal so that the motor 6 operates to feed the ribbon 1. The signal D is also delivered to the CPU 13 so as to inhibit other operations during the feed operation. As the ribbon is transported, the label 2 is peeled off the ribbon, projecting over the separator 5, and ultimately the front edge 121 of the label 2 is detected by the label detector 122. Then, the signal B from the front edge detector 129 goes low. At this time, since the label detector 122 detects the front edge 121 earlier than the second label detector 128, the signal B is directly delivered to the feed controller 131 as signal B' through the gate means 135. In response to the signal B', the feed controller 131 starts to count the signal C from the slit detector 127. When the count reaches the number which has been preset to the feed amount setup switch 132, the signal D goes low to stop the motor 6. Accordingly, the label 2 is stopped following a certain amount of transportation after its front edge 121 has been detected by the label detector 122. The reference signal is created by the detection of the front edge 121 which provides a large transmissivity difference so far as the label 2 is not transparent and also independence from the printed portion 20 of the label 2, thus resulting in a very accurate detection.

The signal B strays low unless the label 2 is removed, holding the signal A from being generated. Thus, other operations are held and double issuing of the label 2 does not occur. Accordingly, the label detector 122 also serves as a detector for sensing the presence of a label as in the case of the conventional system.

By the way, suppose the operator put his finger into the label detector 122 before the front edge 121 of the label 2 has reached the detector 122, the signal B goes low as in detecting the front edge. In this case, however, the finger is detected by the second label detector 128 located outwardly, causing the signal B2 to go low earlier than the signal B, in contrast to the normal operation in which the label detector 122 operates first then the second label detector 128 operates. Then, the gate means 135 keeps the inhibition state so that control is switched to the label transportation by the standard feed amount LA. After the auxiliary feed means 134 has completed the count operation and the label 2 has traveled for the standard feed amount LA, the front edge detection is recognized. Then, the gate means 135 issues the signal B', causing the feed controller 131 to feed the ribbon for the constant length. Thus, even if the label detector 122 operates erroneously due to the insertion of the operator's finger, it is checked by the second label detector 128 on the basis of the sequence of detection and control is switched to the label feed by the standard feed amount LA, resulting in a reduction of the label positioning error.

Figure 25:
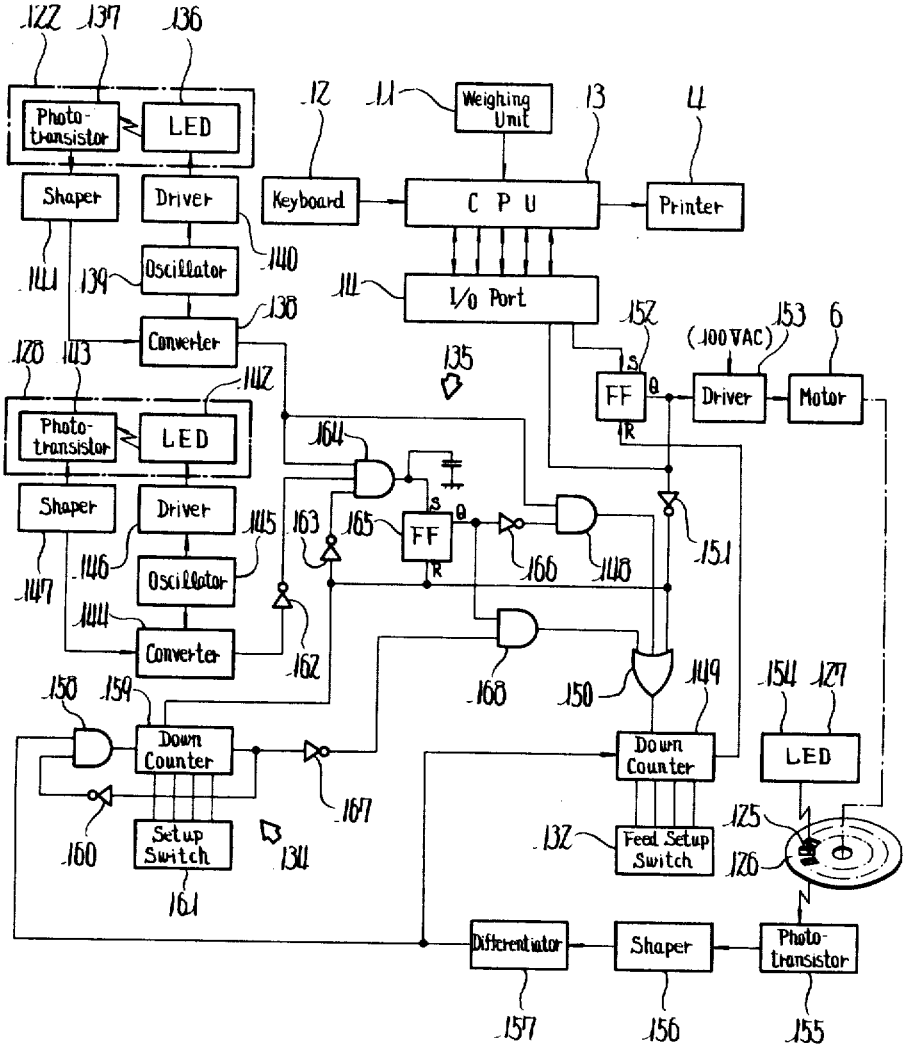
FIG. 25 is a detailed block diagram based on FIG. 24.

The fourth embodiment will further be described in detail with reference to FIG. 25. FIG. 25 merely particularizes the blocks of FIG. 24, and there is no difference in the basic operation. The label detector 122 consists of an LED 136 and a photo-transistor 137, and the LED 136 is connected through a driver 140 to an oscillator 139 which is connected to a converter 138. The photo-transistor 137 is connected through a waveform shaper 141 to the converter 138. The oscillator 139 oscillates in a frequency of about 3 kHz so that the LED 136 emits light pulses periodically. The converter 138 converts the pulse output from the photo-transistor 137 into a DC voltage signal having a high and low levels. The converter 138 outputs a high level when the label is absent, and outputs a low level when the label exists. The purpose of using such flashing light in detecting the label is to prevent the effect of external light and also to obtain an intensified light from the LED 136 which is located far from the photo-transistor 137, so as to enhance the reliability of detection. The second label detector 28 also consists of an LED 142 and a photo-transistor 143, and is also provided with a converter 144, oscillator 145, driver 146, and waveform shaper 147.

The converter 138 is connected to an AND gate 148, which is connected through an OR gate 150 to a down-counter 149, a principal constituent of a means for feeding the ribbon at a constant pitch. The down-counter 149 is connected to a feed amount setup switch 132. The OR gate 150 has another input connected to an inverter 151, the input of which is connected to the I/O port 14 and to the output Q of a flip-flop 152. The set and reset inputs of the flip-flop 152 are connected to the I/O port 14 and the down-counter 149, respectively. The flip-flop 152 has its output connected through a driver 153 to the motor 6.

The slit detector 127 confronting the slit disk 126 consists of an LED 154 and a photo-transistor 155, and the photo-transistor 155 is connected through a waveform shaper 156 to a differentiator 157 which differentiates the rise and fall transitions of input pulses to produce pulses twice the original pulses derived from the slits 125. The differentiator 157 is connected to the down-counter 149.

Also connected to the differentiator 157 through an AND gate 158 and supplied with a load signal from the inverter 151 is a down-counter 159 which constitutes the principal part of the auxiliary feed means 134. The down-counter 159 has its output connected through an inverter 160 to the input of the AND gate 158. The down-counter 159 is also connected to a setup switch 161 for setting the standard feed amount LA. An AND gate 164 is provided with its inputs receiving a signal from the converter 138, a signal from the converter 144 but inverted by an inverter 162, and a signal from the inverter 151 but further inverted by an inverter 163. The AND gate 164 has its output connected to the set input of a flip-flop 165, the output Q of which is connected through an inverter 166 to the input of the AND gate 148. An AND gate 168 is provided for receiving the output Q of the flip-flop 156 and a signal from the down-counter 159 but inverted by an inverter 167, and having its output connected to the input of the OR gate 150.

Figure 26:
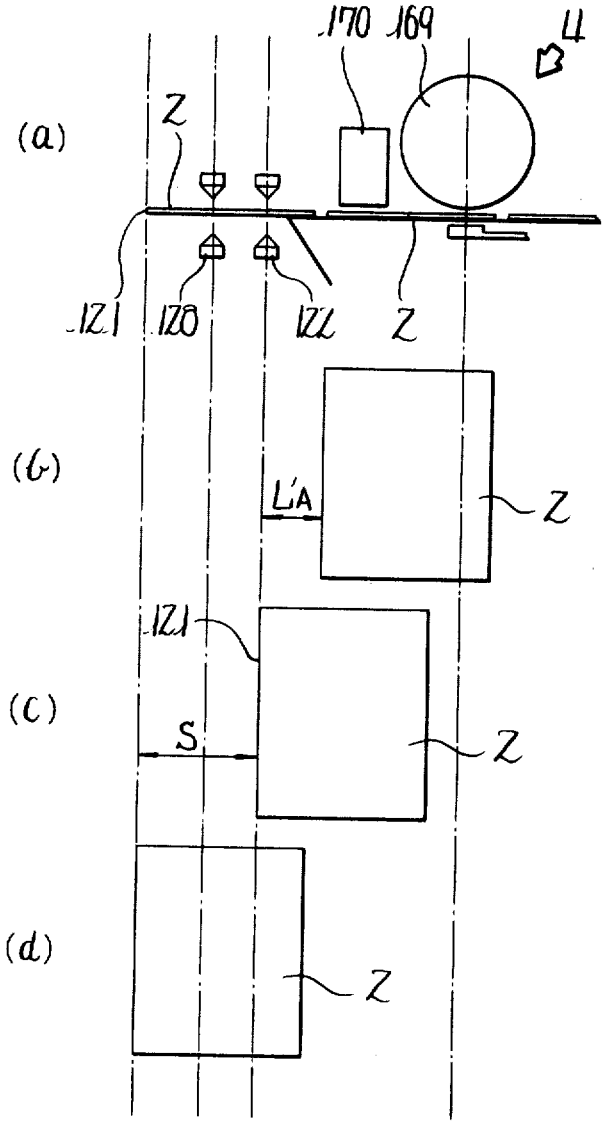
FIG. 26 is an illustration showing the normal label feed by the system of FIG. 25.
Figure 27:
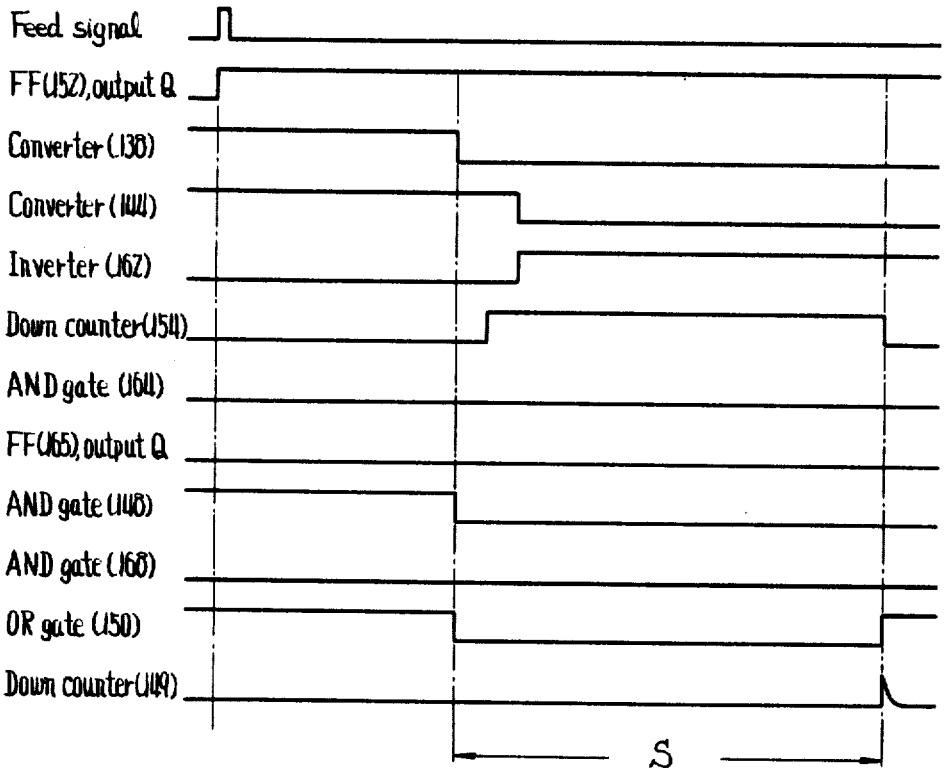
FIG. 27 is a timing chart for the operation of FIG. 26.
Figure 20:
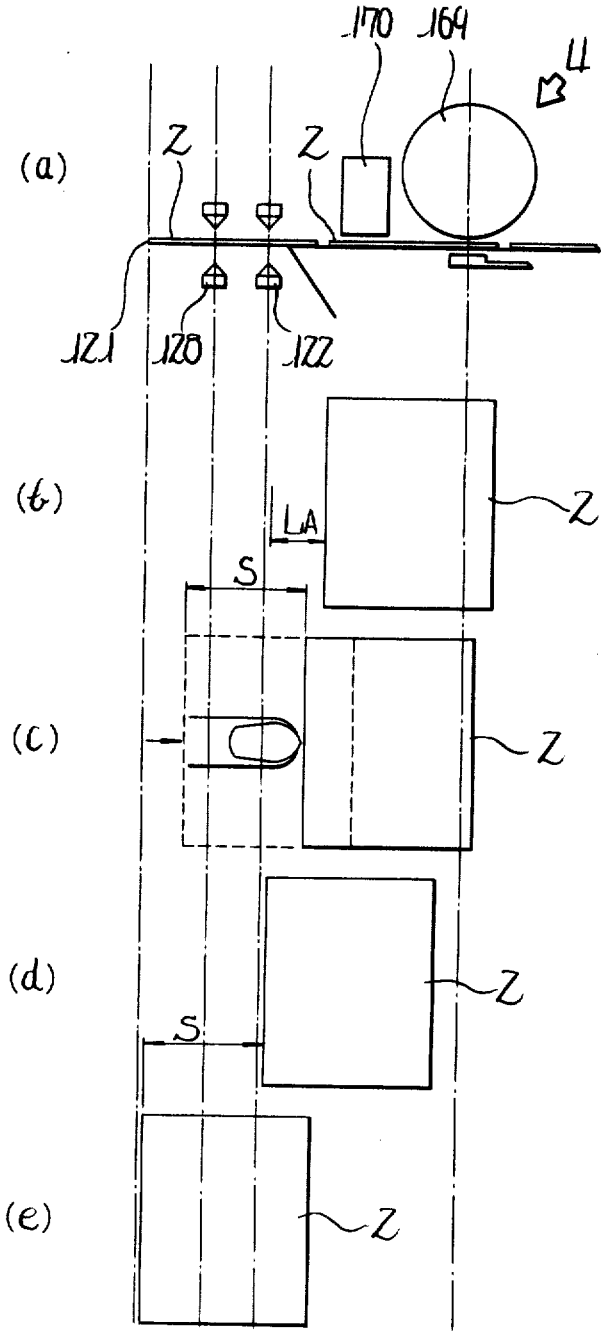

The feed amount setup switch 132 is set to the number of pulses corresponding to the constant feed amount S shown in FIG. 26, whereas the setup switch 161 is set to the number of pulses corresponding to the standard feed amount LA which is the distance for the label 2 to travel from the feed start position shown in FIG. **26-*b* to the position shown in FIG. 26-*c* at which the front position is detected. That is to say, assuming the feed amount in printing label to be LA' as shown in FIGS. 26-*b* and 26-*c***, these values are set so that the LA' ranges within LA±a (where a is the error).

In FIGS. 26 and 28, a printer 4 consists of a data printing unit 169 such as a line printer and a commodity stamp 170.

In the state shown in FIG. **26-*a*, when the label 2 has been removed and is absent from the label detector 122, or when the flip-flop 152 is in the reset state, the OR gate 150 outputs a high level to load the down-counter 149 with the contents of the feed amount switch 132. This operation may be considered as presetting, since the down-counter 149 is loaded irrespective of its initial contents when a high level is given by the OR gate 150. In this state, when the flip-flop 152 receives a feed signal from the I/O port 14, it is set, causing the inverter to output a low level and, at the same time, the driver 153 to supply the power of 100 VAC to the motor 6. Then, the motor 6 rotates to feed the ribbon 1, and the rotating slit disk 126 causes the photo-transistor 155 to emit pulses which in turn are supplied to the down-counter 149. The down-counter 149, however, does not change its contents, because it still receives a high level through the AND gate 148 due to a high level output from the converter 138. When the feed operation is started, the low output of the inverter 151 releases the down-counter 159 from loading, and it starts to count down in response to input pulses from the photo-transistor 155**.

When the label 2 comes to the position as shown in FIG. **26-*c*, the font edge 121 is detected by the label detector 122, and the output of the converter 137 goes low. At this point, since the second label detector 128 does not detect the label 2, the output of the AND gate 164 is inhibited. Accordingly, the flip-flop 165 is not set and the AND gate 168 keeps the output at a low level. The AND gate 148 outputs a low level and the down-counter 149 is released from loading. That is to say, when the down-counter 149 receives pulses from the slit detector 127 after the output of the converter 138 has turned low, it is counted down and the flip-flow 152 is reset when the contents reaches zero. Then, the motor 6 is stopped and the down-counters 149 and 150** are loaded again.

After the front edge 121 of the label 2 has been detected at the position shown in FIG. **26-*c*, the ribbon 1 is transported for the constant amount of S to the position shown in FIG. 26-*d*, then it is stopped. FIGS. 26-*b* through 26-*d* show the normal transportation of the label 2, and FIG. 27** shows the timing of the signals during the operation.

Figure 29:
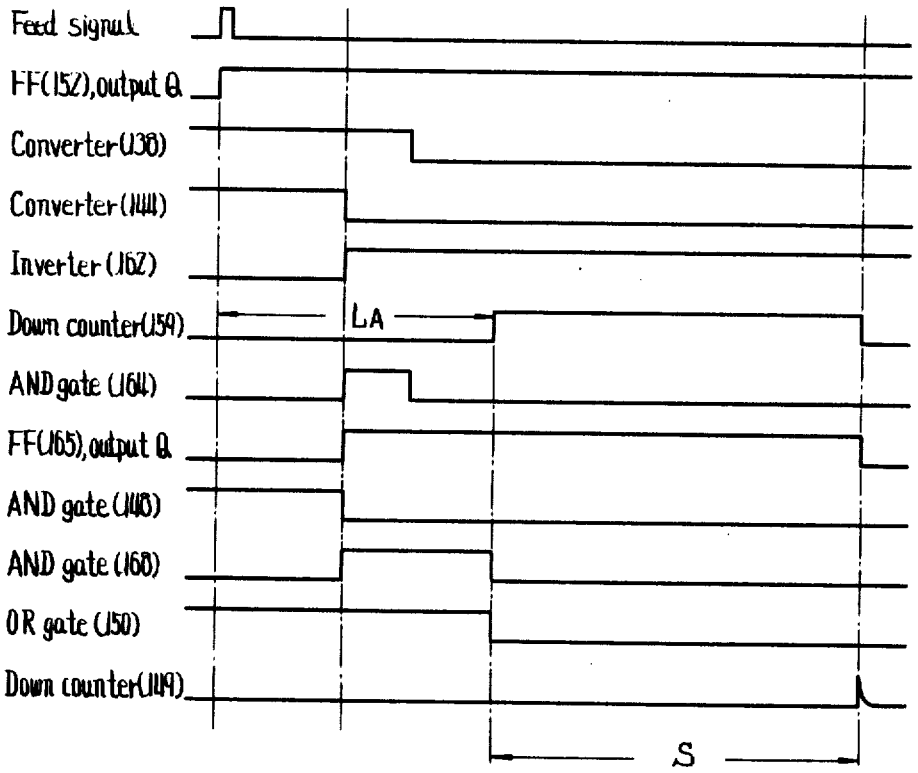
FIG. 29 is a timing chart for the operation of FIG. 28.
Figure 30:
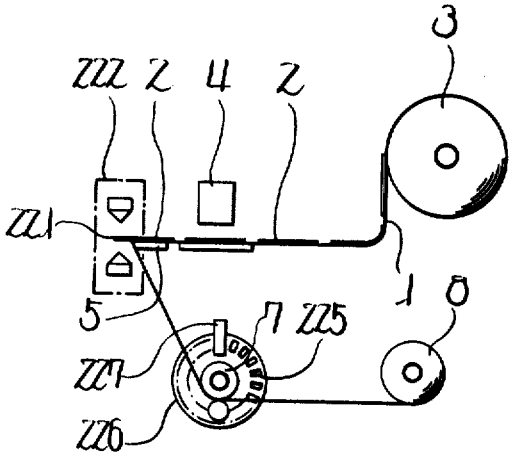
FIG. 30 is a side view of the fifth embodiment of the present invention.
Figure 31:
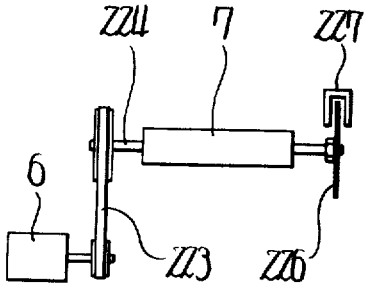
FIG. 31 is a rear view of the feed roller section of FIG. 30.
Figure 32:
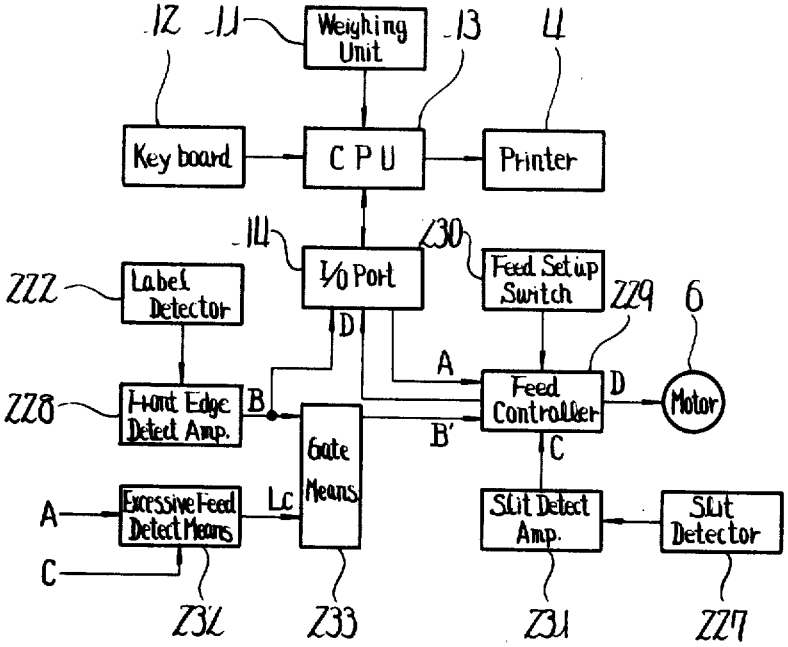
FIG. 32 is a block diagram of the fifth embodiment system.

In the arrangement, when the transportation of the ribbon 1 has been started at the position shown in FIG. **28-*b*, and if the operator puts his finger into the label detector 122 and the second label detector 128 at the position shown in FIG. 28-*c*, the label detector 122 responds to this action even through the front edge 121 of the label 2 does not reach the detector, causing the converter 138 to output a low level. In this case, however, the second label detector 128 located outwardly first detects the finger to bring the converter 144 outputting a low level. Then, the output of the AND gate 164 sets the flip-flop 165, causing the AND gate 168 to output a high level. Thus, even if the AND gate 148 outputs a low level, the down-counter 149 is not released from loading. Transportation of the ribbon proceeds without being controlled by the down-counter 149. At the same time, the down-counter 159 continues to count down, and when it becomes empty the AND gate 168 outputs a low level, releasing the down-counter 149 from loading. Then, the label 2 is transported from the feed start position shown in FIG. 28-*b* to the position shown in FIG. 28-*d* for the standard feed amount LA, and the front edge detection is recognized. From this position, the label is transported for the constant length S under control of the down-counter 149. If the present embodiment were not employed, the label would be transported for the length S as shown by the dotted line in FIG. 28-*c*, resulting in a large positioning error. According to this embodiment, the label is transported for the length S from the position which deviates less distance from the normal front edge detecting position, resulting in a less effect on the positioning of the succeeding label to be printed. FIG. 29** shows the timing of the signals during the operation.

Whereas the above embodiment employs the down-counters 149 and 150, they may be replaced with much inexpensive up-counters, so that respective positions are determined by use of comparators which compare the contents of the up-counters with the setup switches 132 and 161.

It is also possible to employ a motor which rotates in synchronization with the power frequency, so that the constant feed amount is determined by counting the power frequency and the auxiliary feed means 134 is preset to the standard feed amount LA corresponding to the power frequency for the subsequent count down operation. It is also possible to employ a stepping motor which rotates in response to the signal from an oscillator, so that the constant feed amount is determined by counting the pulse signal from the oscillator and the auxiliary feed means 134 is preset to the standard feed amount LA corresponding to the frequency of the oscillator for the subsequent count down operation.

The fifth embodiment of the invention will be described with reference to FIGS. 30 through 37. In these figures, the same reference numbers are used for the identical portions shown in FIGS. 1 through 4 and the explanation thereof will be omitted. A label detector 222 is provided for detecting that the front edge 221 of a label 2 has reached the front of a separator 5 during the transportation of a base ribbon 1, and also for detecting the presence of a label 2. On a shaft 224 of a feed roller 7 driven by an induction motor 6 and a belt 223, there is mounted a slit disk 226 with many slits 225 provided on the circumference thereof. Confronting the slit disk 226, there is provided a slit detector 227 for sensing the slits 225. An I/O port 14 is connected to a CPU 13, and further connected to the label detector 222 through a front edge detection amplifier 228. The I/O port 14 is further connected to a feed controller 229, to which the motor 6 is connected. The feed controller 229 is connected to a feed amount setup unit 230 such as a digital switch, and further connected to the slit detector 227 through a slit detection amplifier 231.

There is provided an excessive feed detection means 232 which has a setup of the excess detection feed amount LC that is larger than the standard feed amount LA in which the label travels after the feed has started until the front edge 221 of the label 2 is detected in normal transportation, and operates to count signals from the slit detection amplifier 231 in response to the feed start signal A from the I/O port 14. There is further provided a gate means 233 which operates such that if the label detector 222 produces a label detection signal B, it is directly delivered to the feed controller 229 as signal B', or if the label detector 222 does not produce a label detection signal B during the count operation of the excessive feed detection means 232, the signal B is delivered to the feed controller 229 on completion of the count operation by the excessive feed detection means 232.

In normal operation, when the label 2 is absent from the label detector 222, the signal B is at a high level. If the CPU 13 generates a signal A while the signal B is high, the feed controller 229 produces a high D-signal so that the motor 6 operates to feed the ribbon 1. The signal D is also delivered to the CPU 13 so as to inhibit other operations during the feed operation. As the ribbon 1 is fed, the label 2 is peeled off the ribbon, projecting over the separator 5, and ultimately the front edge 221 of the label 2 is detected by the label detector 222. Then, the signal B from the front edge detection amplifier 228 goes low. At this time, the signal B is directly sent as signal B' through the gate means 233 to the feed controller 229, which in turn starts to count signals C from the slit detector 227. When the count reaches a number which has been preset on the feed amount setup switch 230, the signal D goes low to stop the motor 6. Accordingly, the label 2 is stopped following a certain amount of transportation after its front edge 221 has been detected by the label detector 222. In this arrangement, the reference signal is created by the detection of the front edge 221 which provides a large transmissivity difference so far as the label 2 is not transparent and also independence from the printed portion 20 on the label 2, thus resulting in a very accurate detection.

The signal B stays low unless the label 2 is removed, holding the signal A from being generated. Thus, other operations are held and double issuing of the label 2 does not occur. Accordingly, the label detector 222 also serves as a detector for sensing the presence of a label as in the case of the conventional system.

By the way, suppose the front edge 221 of the label 2 has reached the label detector 222, but it is not detected by the label detector 222 due to malfunctioning, and the detection signal B maintains a high level. In this case, the excessive feed detection means 232 is counting and the gate means 233 does not transmits the signal B', causing the ribbon 1 to be fed continuously. After the excessive feed detection means 232 has completed the count operaticn and the label 2 has been fed for the excess detection feed amount LC, the front edge detection is assumed. Then, the gate means 233 outputs the signal B', and the label is fed for the constant amount under control of the feed controller 229. Thus, even if the arrival of the label 2 to the label detector 222 is not detected due to malfunctioning of the detector, the front edge detection is assumed upon transportation for the excess detection feed amount LC, thus the label positioning error can be limited within a certain range.

Figure 33:
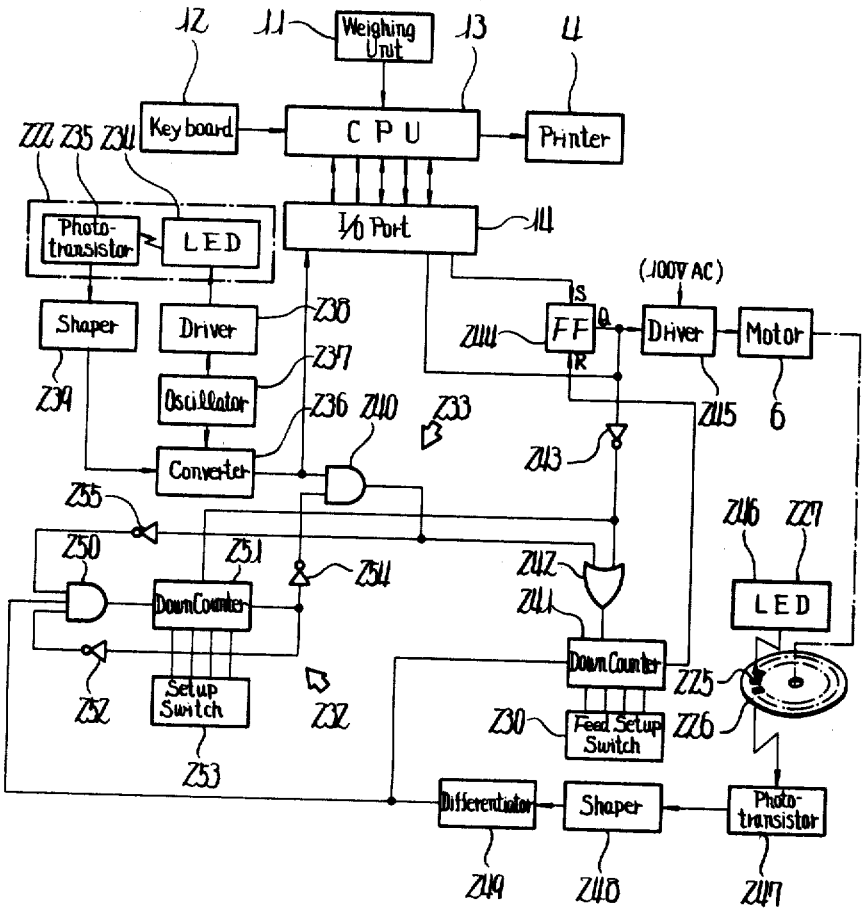
FIG. 33 is detailed block diagram based on FIG. 32.

The fifth embodiment will further be explained in detail with reference to FIG. 33. FIG. 33 merely particularizes the blocks of FIG. 32, and there is no difference in the basic operation. The label detector 222 consists of an LED 234 and a photo-transistor 235, and the LED 234 is connected through a driver 238 to an oscillator 237 which in turn is connected to a converter 236. The photo-transistor 235 is connected through a waveform shaper 239 to the converter 236. The oscillator 237 oscillates in a frequency of about 3 kHz so that the LED 234 emits light pulses periodically. The converter 236 converts the pulse output from the photo-transistor 235 into a DC voltage signal having a high and low levels. The converter 236 outputs a high level when the label is absent, and outputs a low level when the label exists. The purpose of using such flashing light in detecting the label is to prevent the effect of external light and also to obtain an intensified light from the LED 234 which is located far from the photo-transistor 235, thereby enhancing the reliability of the detection.

The converter 236 is connected to the I/O port 14 and to an AND gate 240 which is connected through an OR gate 242 to a down-counter 241, a principal constituent of a means for feeding the ribbon at a constant pitch. The down-counter 241 is connected to the feed account setup switch 230. Another input of the OR gate 242 is connected to an inverter 243, the input of which is connected to the I/O port 14 and to the output Q of a flip-flop 244. The set and reset inputs of the flip-flop 244 are connected to the I/O port 14 and the down-counter 241, respectively. The output of the flip-flop 244 is connected through a driver 245 to the motor 6.

The slit detector 227 confronting the slit disk 226 consists of an LED 246 and a photo-transistor 247. The photo-transistor 247 is connected through a waveform shaper 248 to a differentiator 249 which differentialties the rise and fall transitions of input pulses to produce pulses twice the original pulses derived from the slits 225. The differentiator 249 is connected to the down-counter 241. Also connected to the differentiator 249 through an AND gate 250 and supplied with a load signal from the inverter 243 is a down-counter 251 which constitutes the principal part of the excessive feed detection means 232. The output of the down-counter 251 is connected through an inverter 252 to the input of the AND gate 250. The down-counter 251 is also connected to a setup switch 253 for setting the excess detection feed amount LC. The output of the down-counter 251 is supplied through an inverter 254 to the AND gate, the principal constituent of the gate means 232, which also receives a signal from the converter 236. The output of the AND gate 240 is supplied through an inverter 255 to the AND gate 250.

Figure 34:
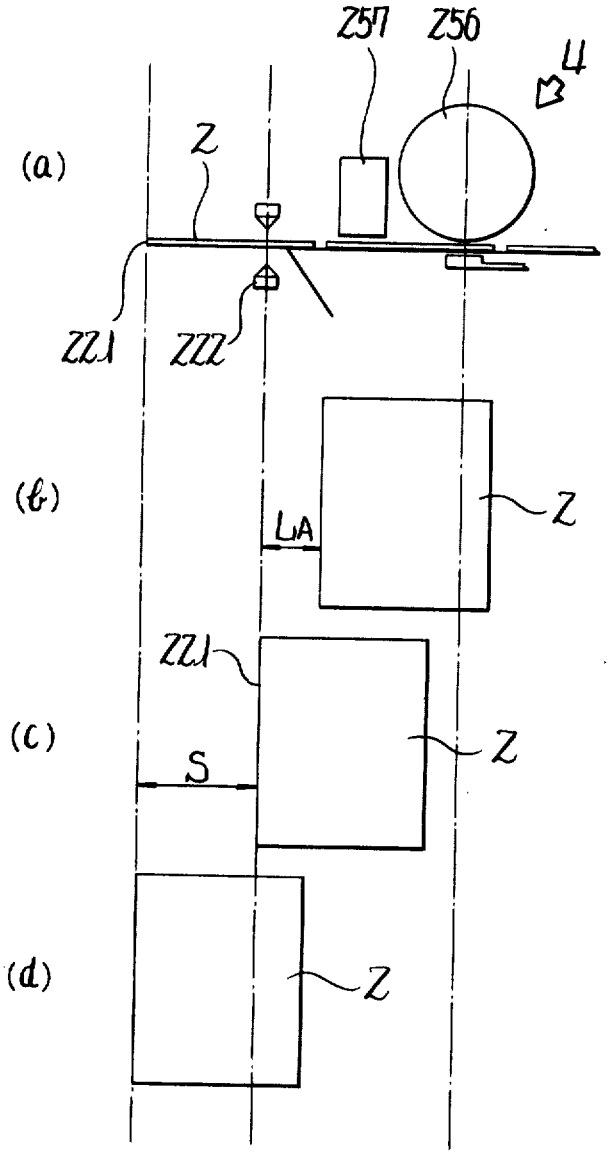
FIG. 34 is an illustration showing a normal label feed by the system of FIG. 33.

The feed amount setup switch 230 is set to the number of pulses corresponding to the constant feed amount S shown in FIG. 34. The setup switch 253 is set to the excess detection feed amount LC which is larger than the standard feed amount LA, that is the number of pulses for feeding the ribbon from the feed start position shown in FIG. 34-*b* the front edge detecting position shown in FIG. 34-*c*, by the amount determined by way of experiment in consideration of the pitch error of the motor 6 and the dimensional error of the label 2.

Figure 36:
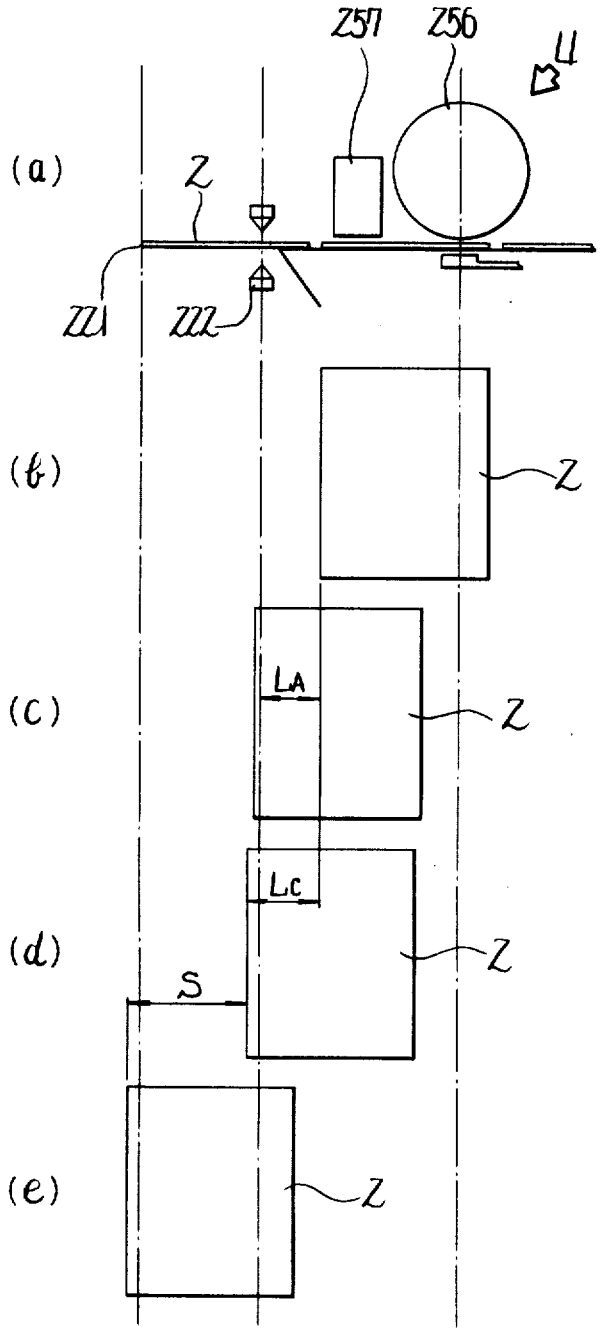
FIG. 36 is an illustration showing the abnormal label feed.
Figure 38:
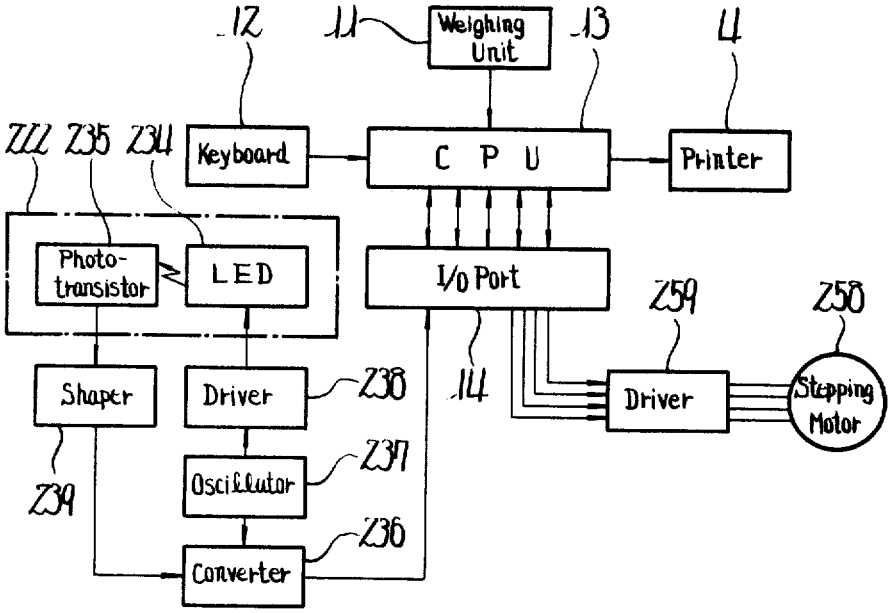
FIG. 38 is a block diagram showing the sixth embodiment of the present invention.

In FIGS. 34 and 36, a printer 4 consists of a data printing unit 256 such as a line printer and a commodity stamp 257.

In the state shown in FIG. 34-*a*, when the label 2 has been removed and is absent from the label detector 222, or when the flip-flop 244 is in the set state, the OR gate 242 outputs a high level to load the down-counter 241 with the contents of the feed amount setup switch 230. Thus operation may be considered as presetting, since the down-counter 241 is loaded irrespective of its initial contents when a high level is given by the OR gate 242. In this state, when the flip-flop 244 receives a feed signal from the I/O port 14, it is set, causing the inverter 243 to output a low level and, at the same time, the driver 245 to supply the power of 100 VAC to the motor 6. Then, the motor 6 rotates to feed the ribbon 1, and the rotating slit disk 226 causes the photo-transistor 247 to emit pulses, which in turn are supplied to the down-counter 241 as a clock signal. The down-counter 241, however, does not change its contents, because it still receives a high level through the AND gate 240 due to a high level output from the converter 236. When the feed operation is started, a low output of the inverter 243 releases the down-counter 251 from loading, and it starts to count down in response to the input pulses from the photo-transistor 247.

When the label 2 comes to the position shown in FIG. 34-*c*, the front edge 221 is detected by the label detector 222, and the output of the converter 236 goes low. Then, the output of the OR gate 242 also goes low, releasing the down-counter 241 from loading. That is to say, when the down-counter 241 receives pulses from the slit detector 227 after the output of the converter 236 has turned low, it is counted down and the flip-flop 244 is reset when the contents reaches zero. Then, the motor 6 is stopped and the down-counters 241 and 251 are loaded again.

Figure 35:
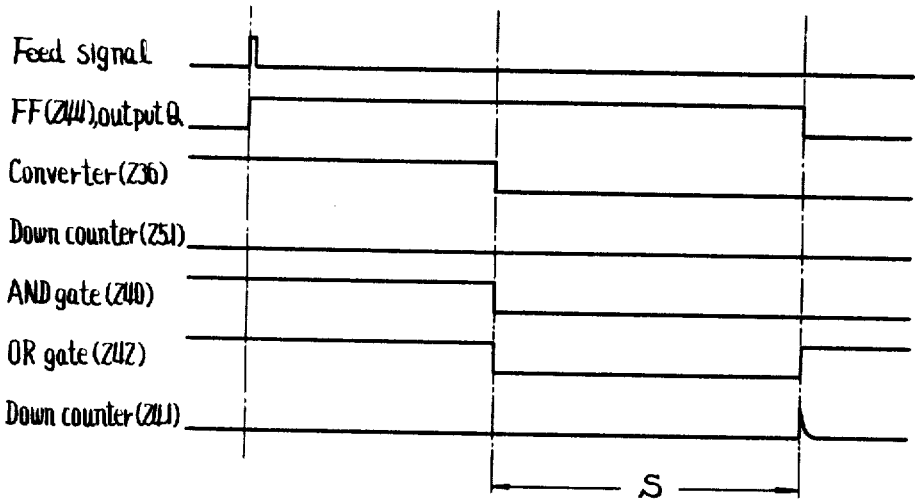
FIG. 35 is a timing chart for the operation of FIG. 34.

After the front edge 221 of the label 2 has been detected at the position shown in FIG. 34-*c*, the ribbon is fed for the constant length S to the position shown in FIG. 34-*d*, then it is stopped. FIGS. 34-*b* through 34-*d* show the normal transportation of the label 2, and FIG. 35 shows the timing of the signals during the operation.

Figure 37:
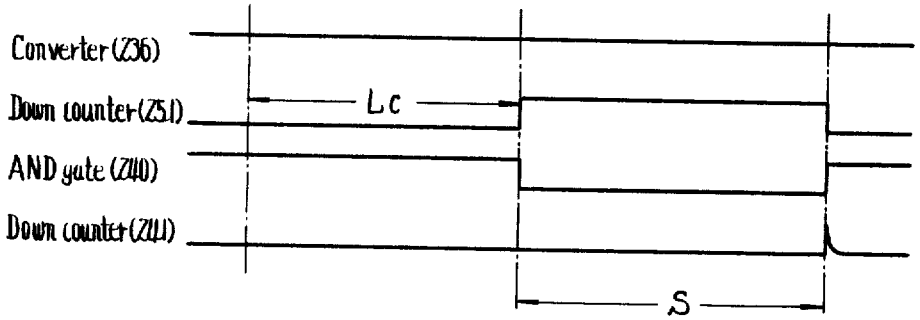
FIG. 37 is a timing chart for the operation of FIG. 36.

By the way, suppose that after the ribbon 1 has been started to feed in response to the feed signal and the front edge 221 of the label 2 reaches the label detector 222 as shown in FIG. 36-*c*, but it fails to produce a detection signal due to malfunctioning. In this case, the converter 36 keeps its output high and does not control the down-counter 241. On the other hand, the down-counter 251 has been counting down the excess detection feed amount LC since the ribbon feed was started, and it outputs a high level when the contents reaches zero. This high level signal is inverted by the inverter 254, and inhibits the AND gate 240. Then, the down-counter 241 is released from loading, and from this moment the label is transported for the constant amount S under control of the down-counter 241. Accordingly, waste of labels 2 by uncontrollable running due to a high level output of the converter 236 can be prevented. Thus, even if the label detector 222 does not operate, the excessive feed can be limited to the value which is the difference between the normal front edge detecting position and the excess detection feed amount LC. FIG. 37 shows the timing of the signals during the operation.

Whereas the above embodiment employs the down-counters 241 and 251, they may be replaced with much inexpensive up-counters, so that the respective positions are determined by use of comparators which compare the contents of the up-counters with the setup switches 230 and 253.

It is also possible to employ a motor which rotates in synchronization with the power frequency, so that the constant feed amount is determined by counting the power frequency and the excessive feed detection means 232 is preset to the excess detection feed amount LC corresponding to the power frequency for the subsequent count down operation. It is also possible to employ a stepping motor which rotates in response to the signal from an oscillator, so that the constant feed amount is determined by counting the pulse signal from the oscillator and the excessive feed detection means 232 is preset to the excess detection feed amount LC corresponding to the frequency of the oscillator for subsequent count operation.

Figure 39:
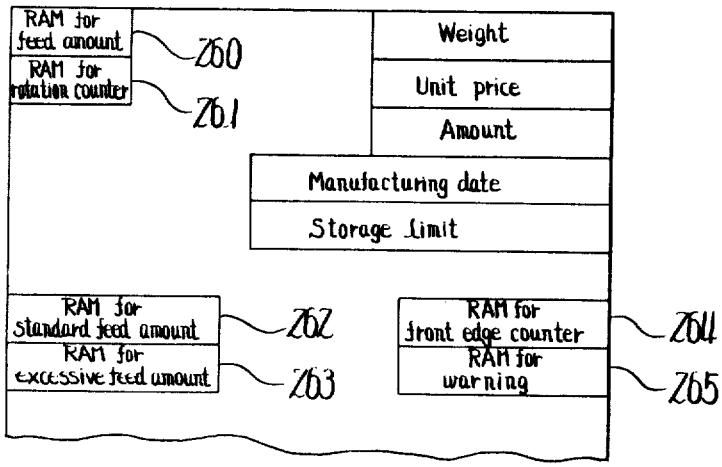
FIG. 39 is an illustration showing the RAM map of the system of FIG. 38.

The sixth embodiment of the invention will be described with reference to FIGS. 38 through 42. In this embodiment, a stepping motor 258 is employed as a drive actuator which operates in program control. An converter 236 is connected to the I/O port 14 which is connected to the CPU 13. A label detector 222 is connected to the converter 236. A stepping motor 258 is connected through a driver 259 to the I/O port 14. As shown in FIG. 39, the CPU 13 has RAMs which includes a feed amount RAM 260, a rotation counter RAM 261, a standard feed amount RAM 262, an excess detection feed amount RAM 263, a front edge counter RAM 264, and a warning RAM 265.

Figure 40:
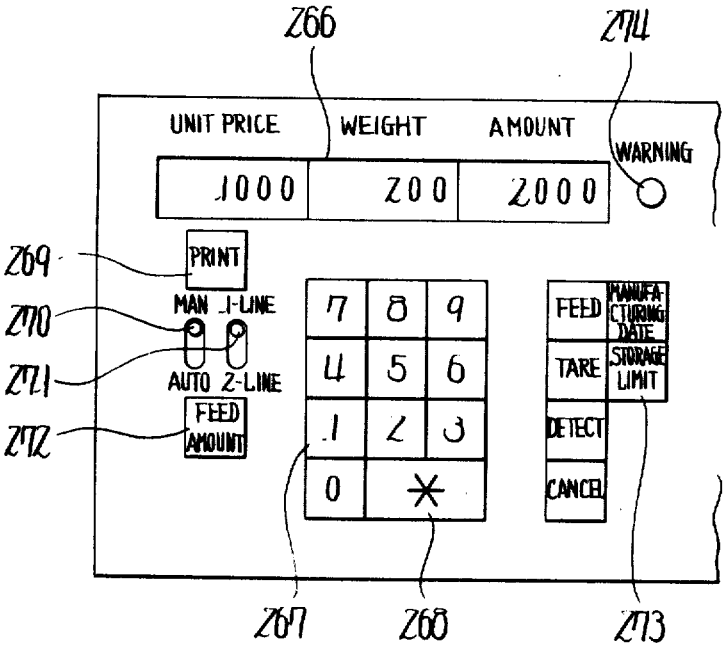
FIG. 40 is a plan view of the keyboard shown in FIG. 38.

FIG. 40 shows the layout of the keyboard, which includes a read out unit 266 divided into UNIT PRICE, WEIGHT and AMOUNT fields, a ten-key 267 for entering numeric data, an EXECUTION key 268, a PRINT key 269, a MAN/AUTO mode selector switch 270, a 1-LINE/2-LINE print mode selector switch 271, and a FEED AMOUNT key 272. The keyboard is further provided with function keys 273 including a FEED key, a WARE key, a DETECTION amount setup key, a MANUFACTURING DATE setup key, a STORAGE LIMIT setup key, and a CANCEL key. There is further provided an abnormality WARNING lamp 274.

Figure 41:
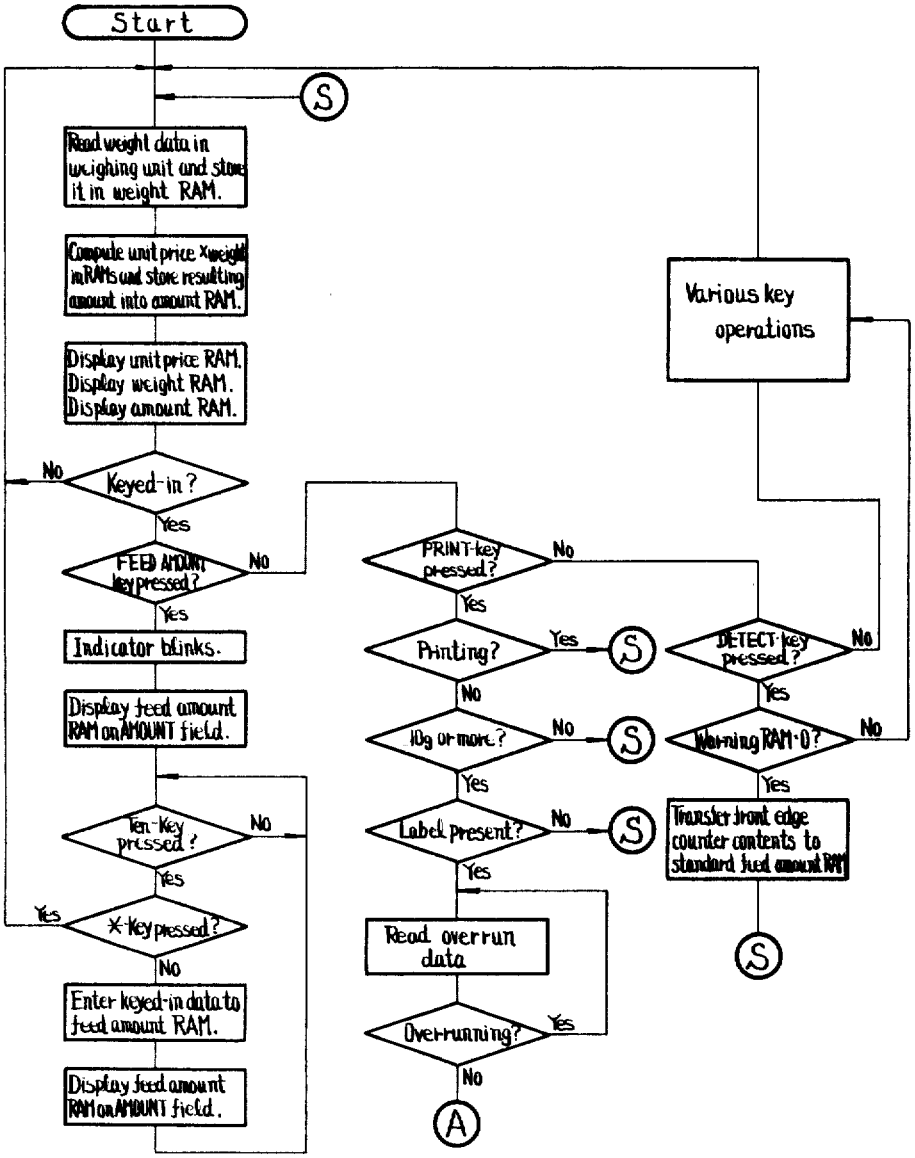
FIGS. 41 and 42 are flowcharts showing the operation of the sixth embodiment system.

On the flowchart of FIG. 41, when the system starts, a weight data derived from the weighing unit 11 is loaded into the weight RAM. The weight data is multiplied with the contents of the unit price RAM which has been preset, and the result is stored in the amount RAM. The contents of the unit price RAM, weight RAM and amount RAM are displayed on the respective fields of the read out unit 266. Then, the setup of the operational modes such as the MAN/AUTO mode are checked. After entry for these keys has been confirmed, entry of the FEED AMOUNT key 272 is checked.

Entry of the FEED AMOUNT key 272 sets the feed amount S in which the label 2 travels after its front edge has been detected by the label detector 222. When the FEED AMOUNT key 272 is pressed, the read out unit 266 turns off lighting, and the contents of the feed amount RAM 260 are displayed on the AMOUNT field of the read out unit 266. This displayed value is an old data, and by using the ten-key 267 a new data is entered into the feed amount RAM 260 and displayed on the read out unit 266 for confirmation. By pressing the EXECUTION key 268, the feed amount S is set, and the unit price, weight and amount are displayed again on the read out unit 266.

After the feed amount has been set or the previous setting is not changed, the system operates according to the key entry. Suppose the DETECTION amount setup key is pressed with the contents of the warning RAM 265 being "O", the contents of the front edge counter 264, which measures the distance from the position at which transportation has started to the position at which the front edge 221 of the label 2 is detected, are stored in the standard feed amount RAM 262 so as to set the standard feed amount LA. If the contents of the warning RAM 265 are not "O", the DETECTION amount setup key has no effect, and control returns to point S on the flowchart. When the PRINT key 267 is pressed, it is checked if printing is being carried out. During printing, control returns to point S, or if not, weight data is checked if it is 10 grams or more. This checking verifies if a commodity is surely loaded to the weighing unit 11, and at the same time, various checks for the weighing unit, such as the overflow of the amount are carried out. Next, the label detector 222 checks the presence of the label. If the label is detected, control returns to point S in order to prevent double issuing of the label, and if not, overrun data is read in. The overrun data is not obtained by the circuit of FIG. 38, but provided by an overrun detecting device which is not shown in the figure. During the overrun, the system waits for the end of the overrun, then control proceeds to point A on the flowchart.

Figure 42:
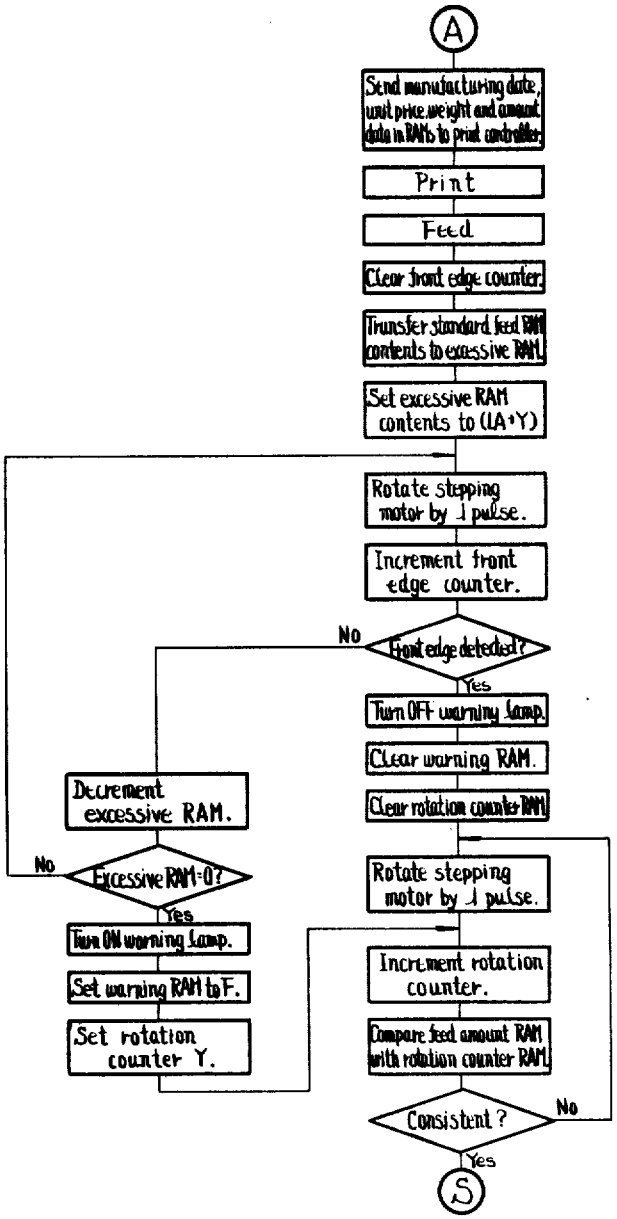

From point A, the process continues as shown on the flowchart of FIG. 42. The contents of the manufacturing date, unit price, weight and amount RAMs are transferred to the print controller, then printed by the printer 4. When the transportation of the ribbon 1 is started, the front edge counter RAM 264 is cleared, and the contents of the standard feed amount RAM 262 are transferred to the excess detection feed amount RAM 263, so that it is set to the excess detection feed amount LC obtained by adding the standard feed amount LA to Y (where Y is a constant value). After that, the stepping motor 258 is rotated by one pulse and it is counted by the front edge counter RAM 264. It is checked if the front edge 221 of the label 2 is detected by the label detector 222, and if it is not detected, the excess detection feed amount RAM 263 is decremented by one. If the contents of the RAM 263 have not reached zero, the stepping motor 258 is rotated by one pulse. This operation continues until the label detector 222 detects the front edge 221 of the label 2. The stepping motor 258 steps rotating to feed the label 2, and when the label detector 222 detects the front edge 221, the contents of the warning RAM 265 become zero, causing the rotation counter RAM 261 to be cleared. The abnormality WARNING lamp 274 is kept off. Subsequently, the stepping motor 258 rotates by one pulse, causing the rotation counter RAM 261 to be incremented by one. The feed amount RAM 260 stores the preset value as mentioned previously. The rotation counter RAM 261 is incremented continuously until the contents of the RAMs coincide. When both RAMs coincide, the stepping motor 258 is stopped, and control returns to the beginning.

If the decrementing excess detection feed amount RAM 263 reaches zero before the front edge 221 of the label 2 is detected by the label detector 222, the abnormality WARNING lamp 274 lights up and the flag is set to the warning RAM 265. The rotation counter RAM 261 is set to Y, the stepping motor 258 rotates by one pulse, then the rotation counter RAM 261 is incremented by one. Then, the RAM 261 is compared with the feed amount RAM 260. After the stepping motor 258 has rotated by S−Y pulses, both RAMs coincide and the motor stops. Control, then, returns to the beginning. In this case, the label is fed by LA+Y before the excess detection feed amount RAM 263 reaches zero and, after that, further fed by S−Y. Thus, the label is fed by a total of LA+S. Consequently, the positioning error of the label 2 can be made small.

What is claimed is:

1. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an auxiliary feed means provided with a setting of a standard feed amount corresponding to a length in which said base ribbon travels after the ribbon feed has started until the front edge of said label is detected in normal operation, and adapted to count said standard feed amount on starting the ribbon transportation;

an abnormal feed detection means provided with a setting of an abnormality detection feed amount which is smaller than said standard feed amount, and adapted to count said abnormality detection feed amount on starting the ribbon transportation; and a gate means for invalidating a front edge detection signal when it is issued by said label detector during the count operation of said abnormal feed detection means so that the feed operation for said standard feed amount set to said auxiliary feed means continues, and for activating said incremental feed means after said base ribbon has been fed for said standard feed amount.

2. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an auxiliary feed means which memorizes at each label issuing a feed amount in which said base ribbon travels after the ribbon feed has started until the front edge of said label is detected, and provided with a setting of an immediate feed amount as a standard feed amount by pressing a feed amount setup key, and adapted to count said standard feed amount on starting the ribbon transportation;

an abnormal feed detection means which is set by operating said feed amount setup key to an abnormality detection feed amount that is smaller than said standard feed amount by a certain value, and adapted to count said abnormality detection feed amount on starting the ribbon transportation; and a gate means for invalidating a front edge detection signal when it is issued by said label detector during the count operation of said abnormal feed detection means so that the feed operation for said standard feed amount set to said auxiliary feed means continues, and for activating said incremental feed means after said base ribbon has been fed for said standard feed amount.

3. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an auxiliary feed means which is preset to a standard feed amount corresponding to a length in which said base ribbon travels after the ribbon feed has started until the front edge of said label is detected in normal operation, and adapted to count said standard feed amount on starting the ribbon transportation;

an abnormal feed detection means provided with a setting of an abnormality detection feed amount smaller than said standard feed amount by a certain value, and adapted to count said abnormality detection feed amount on starting the ribbon transportation; and a gate means for invalidating a front edge detection signal when it is issued by said label detector during the count operation of said abnormal feed detection means so that the feed operation for said standard feed amount set to said auxiliary feed means continues, and for activating said incremental feed means after said base ribbon has been fed for said standard feed amount.

4. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an auxiliary feed means provided with a setting of a standard feed amount corresponding to a length in which said base ribbon travels after the ribbon feed has started until the front edge of said label is detected in normal operation, and adapted to count said standard feed amount on starting the ribbon transportation;

an abnormal feed detection means provided with a setting of an abnormality detection feed amount which is smaller than said standard feed amount, and adapted to count said abnormality detection feed amount on starting the ribbon transportation;

a gate means for invalidating a front edge detection signal when it is issued by said label detector during the count operation of said abnormal feed detection means so that the feed operation for said standard feed amount set to said auxiliary feed means continues, and for activating said incremental feed means after said base ribbon has been fed for said standard feed amount; and an abnormality warning lamp which lights when said base ribbon has been fed for said standard feed amount by said auxiliary feed means.

5. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an auxiliary feed means provided with a setting of a standard feed amount corresponding to a length in which said base ribbon travels after the ribbon feed has started until the front edge of said label is detected in normal operation, and adapted to count said standard feed amount on starting the ribbon transportation;

an abnormal feed detection means provided with a setting of an abnormality detection feed amount which is smaller than said standard feed amount, and adapted to count said abnormality detection feed amount on starting the ribbon transportation;

a gate means for invalidating a front edge detection signal when it is issued by said label detector during the count operation of said abnormal feed detection means so that the feed operation for said standard feed amount set to said auxiliary feed means continues, and for activating said incremental feed means after said base ribbon has been fed for said standard feed amount;

an excessive feed detection means provided with a setting of a excess detection feed amount which is larger than said standard feed amount, and adapted to count said excess detection feed amount on starting the ribbon transportation; and a second gate means for activating said incremental feed means on completion of the count operation of said excessive feed detection means if a front edge detection signal has not been issued by said label detector during the count operation of said excess feed detection means.

6. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an auxiliary feed means provided with a setting of a standard feed amount corresponding to a length in which said base ribbon travels after the ribbon feed has started until the front edge of said label is detected in normal operation, and adapted to count said standard feed amount on starting the ribbon transportation;

a second label detector disposed on the downstream side of said label detector; and a gate means which allows said auxiliary feed means to continue the feeding of said base ribbon for said standard feed amount when said second label detector issues a front edge detection signal earlier than said first mentioned label detector, and activates said incremental feed means after said base ribbon has been fed for said standard feed amount.

7. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an excess feed detection means provided with an excess detection feed amount which is larger than a length in which said base ribbon travels after the ribbon feed has started until the front edge of said label is detected, and adapted to count said excess detection feed amount on starting the ribbon transportation; and a gate means for activating said incremental feed means on completion of the count operation of said excessive feed detection means if a front edge detection signal has not been issued by said label detector during the count operation of said excessive feed detector.

8. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an excessive feed detection means which memorizes at each label issuing a feed amount in which said base ribbon travels after the ribbon feed has started until the front edge of said label is detected, and provided with a setting of an immediate feed amount added by a certain detection value as an excess detection feed amount, and adapted to count said excess detection feed amount on starting the ribbon transportation; and a gate means for activating said incremental feed means on completion of the count operation of said excess feed detection means if a front edge detection signal has not been issued by said label detector during the count operation of said excessive feed detection means so that said base ribbon is fed for a certain amount subtracted by said certain detection value.

9. A label feed control system comprising:

a driver means for driving a feed means which transports a paper base ribbon with labels stuck thereon;

a separator means for peeling said label off said base ribbon;

a label detector disposed in the vicinity of said separator means for detecting the front edge of said peeled-off label;

an incremental feed means for controlling the operation of said driver means such that said base ribbon is fed for a certain amount after said label detector has detected the front edge of said peeled-off label;

an excessive feed detection means provided with a setting of an excess detection feed amount which is larger than a length which said base ribbon travels after the ribbon feed has started until the front edge of said label is detected in normal operation, and adapted to count said excess detection feed amount on starting the ribbon transportation; and a gate means for activating said incremental feed means on completion of the count operation if a front edge detection signal has not been issued by said label detector during the count operation of said excessive feed detection means.

* * * * *